US005677058A

United States Patent [19]

Neal et al.

[11] Patent Number: 5,677,058

[45] Date of Patent: Oct. 14, 1997

[54] LUBRICANT IMPREGNATED FIBERS AND PROCESSES FOR PREPARATION THEREOF

[75] Inventors: Richard D. Neal; Shriram Bagrodia, both of Kingsport; Lewis C. Trent, Jonesborough; Mark A. Pollock, Johnson City, all of Tenn.

[73] Assignee: Eastman Chemical Company, Kingsport, Tenn.

[21] Appl. No.: 339,619

[22] Filed: Nov. 15, 1994

Related U.S. Application Data

[62] Division of Ser. No. 72,377, Jun. 7, 1993, Pat. No. 5,372,739, which is a division of Ser. No. 734,840, Jul. 23, 1991, Pat. No. 5,234,720, which is a continuation-in-part of Ser. No. 466,849, Jan. 18, 1990, abandoned.

[51] Int. Cl.[6] ..... D02G 3/00

[52] U.S. Cl. ..... 428/375; 428/398; 428/364; 428/393; 428/394; 428/395; 428/397; 428/399; 8/115.51; 8/115.6

[58] Field of Search ..... 428/397, 399, 428/364, 395, 394, 375, 378, 393; 8/115.56

[56] References Cited

U.S. PATENT DOCUMENTS

| | | | |
|---|---|---|---|
| 3,432,898 | 3/1969 | Stanley | 428/396 |
| 3,639,154 | 2/1972 | Sawa et al. | 428/395 |
| 3,850,682 | 11/1974 | Sturwold et al. | 252/8.6 |
| 3,925,589 | 12/1975 | Sturwold et al. | 428/395 |
| 4,201,680 | 5/1980 | Waltenberger et al. | 252/8.6 |
| 4,446,034 | 5/1984 | Kolbe et al. | 252/88 |
| 4,654,155 | 3/1987 | Kipp et al. | 252/32.5 |
| 4,659,489 | 4/1987 | Hill et al. | 252/40.5 |
| 4,851,291 | 7/1989 | Vigo et al. | 428/393 |
| 4,883,604 | 11/1989 | Veitenhansl et al. | 428/395 |
| 5,061,389 | 10/1991 | Reichgott | 252/49.3 |
| 5,135,811 | 8/1992 | White et al. | 428/395 |
| 5,139,873 | 8/1992 | Rebouillat | 428/375 |
| 5,234,720 | 8/1993 | Neal et al. | 427/393.1 |
| 5,372,739 | 12/1994 | Neal et al. | 252/8.6 |

*Primary Examiner*—Jill Gray

*Attorney, Agent, or Firm*—Mark A. Montgomery; Harry J. Gwinnell

[57] ABSTRACT

Fibers such as caustic-treated non-round polyester fibers are prepared having certain lubricants strongly adhered to the surfaces thereof. These fibers are prepared by contacting the fibers, such as immediately prior to a crimping means, with a suitable heated hydrophilic lubricant in a processing operation followed by heating to dry or "bake" the lubricant onto and/or into the surface of the fibers.

19 Claims, 7 Drawing Sheets

LUBRICANT IMPREGNATED FIBERS AND PROCESSES FOR PREPARATION THEREOF

This is a divisional application of application Ser. No. 08/072,377 filed Jun. 7, 1993, now U.S. Pat. No. 5,372,739, Dec. 13, 1994 which is a divisional of Ser. No. 07/734,840 filed Jul. 23, 1991 now U.S. Pat. No. 5,234,720 which is a CIP of Ser. No. 07/466,849 filed Jan. 18, 1990 now abandoned.

FIELD OF THE INVENTION

BACKGROUND OF THE INVENTION

Fibers for nonwoven or textile materials must have certain characteristics in order to be considered useful or desirable. Important performance characteristics to consider in selecting a fiber or fibers for a wide range of nonwoven, knitted and woven products include the following: (1) fiber processability on nonwoven and textile equipment (efficiency, cost effectiveness); (2) fiber/fabric/material "hand" and overall aesthetics when viewed, touched, used or worn (abrasiveness, softness, fiber-covering-power, opacity, comfort, drape, appearance, perception of suitability); (3) strength; (4) abrasion resistance; and (5) when applicable, liquid-transport characteristics (wetting, wicking, absorption, liquid-transport durability).

Nonwoven materials are manufactured by means other than weaving and knitting. The terms "nonwoven" and "nonwoven fabric" are general descriptive terms for a broad range of products, such as absorbent pads, wiping/cleaning webs or fabrics, insulation, aroma/flavor materials, liners, wicks, relatively thick battings, compressed bonded battings or webs, bandages, incontinence structures, filters and many other products. Interest in nonwoven materials is enhanced by the fact that such materials can be mass produced efficiently and at relatively low cost to satisfy many important consumer and industrial needs. Improvements in man-made fibers have contributed to the development of the nonwoven industry.

Man-made materials have become increasingly plentiful and inexpensive. However, in certain characteristics many of these materials do not compare well to natural fibers such as in the ability to transport moisture satisfactorily. Several methods have been devised to improve the characteristics of man-made materials, such as polyester, to more closely resemble natural fiber, such as cotton. U.S. Pat. Nos. 2,590,402, 2,781,242, 2,828,528 and 4,008,044 and the Journal of Applied Polymer Science, Vol. 33, Page 455 (1987) all disclose the treatment of certain polyester fabrics with caustic to improve certain properties such as handle and softness. U.S. Pat. No. 4,374,960 discloses the production of polyester fibers of improved stability that are made by mixing the polyester and an end-capping reagent prior to fiber formation. EP 0,188,091 discloses the production of a highly absorbent nonwoven web by coating the web with super-absorbent polymeric particles. U.S. Pat. No. 4,842,792 discloses fibers of improved cover, softness and wetting characteristics that are produced by caustic treatment of various polyesters which have continuous grooves in the cross-section. It is disclosed in the Journal of Applied Polymer Science, Vol. 25, PP1737–1744 (1980) that a fabric of increased dye uptake can be made using a concentrated non-ionic surfactant TRITON X-100 made by Rohm and Haas Corp.) at a temperature between 180° and 220° C. for five minutes. Removal of excess liquid from fibers is disclosed in U.S. Pat. Nos. 3,458,890 and 3,786,574. Measurement of cohesion of crimped staple fiber is disclosed in U.S. Pat. No. 4,649,605.

All of these various aforementioned characteristics are important; however, unlike fabrics, staple fibers must also be satisfactorily processable in an economical manner under conventional production conditions by the equipment used in nonwoven and textile manufacture. Staple fibers are cut into suitable lengths (usually about 1 to 10 cm) for processing in a manner similar to natural staple fibers, such as cotton, in both textile and nonwoven machinery. These fibers must perform satisfactorily in such known operations as opening, blending, feeding, carding, bonding, heating, compressing, cooling, hydro-entangling, needle-punching, drawing, roving, spinning, knitting, weaving, and others as selected for the various nonwoven or textile materials.

Crimping of staple fiber by various means has been found to be an essential element in producing a certain controlled amount of fiber cohesion or resistance to pulling apart in forming carded webs. These webs of "opened" (separated) fibers are formed in flat-top or roller-top carding machines or the like as part of nonwoven or textile processes.

Poor crimp formation, especially in fibers with non-round cross-sections, has been associated with low and variable cohesion, weak webs, web separation, and poor processability during carding and/or subsequent operations. Relatively high lubricant levels (applied at room temperature), particularly above about 0.2 weight percent, of certain processing lubricants can cause unsatisfactory cohesion and processability problems in carding, etc. When such high levels of these lubricants are applied prior to the crimper (such as by conventional kiss rolls), low fiber-to-metal friction within the crimping chamber interferes with the capability to produce normal crimp frequency (crimps per inch) with sufficiently low (narrow) average crimp angle and relatively "V-shaped" crimp apex. Poor crimp is characterized by comparatively low and/or excessively variable crimp frequency and/or wide (open) average crimp angle; and/or comparatively "U-shaped" crimp apex.

Two types of commonly used processing lubricants are based on potassium lauryl phosphate or mineral oil with the addition of antistatic agents, friction modifiers, etc. as needed. At high levels (above 0.2 to 2 wt. % or greater) these and many other lubricants applied prior to the crimper using prior-art methods (usually lubricant-coated, rotating, contact rolls at approximately room temperature located remote from the crimper input) can have an adverse effect on crimp formation and/or tend to cause problems in carding by poor cohesion and/or by building up relatively quickly a detrimental coating on the carding wire and/or other problems. Additionally, these lubricants do not have good hydrophilic action.

Additionally, for certain applications, liquid-transport durability is a desirable characteristic but difficult to obtain in some man-made fibers. Certain man-made fibers, particularly those with suitable non-round cross-sections, have some initial liquid-transport characteristics. However, after wet usage, washing or scouring, the ability of these fibers to transport liquid can in some instances diminish significantly.

Any method of improving any of the aforementioned characteristics without significant adverse affects on other characteristics would be very desirable.

SUMMARY OF THE INVENTION

The present invention is directed to fibers having improved opening characteristics, cohesion, processability, hand, and/or liquid-transport properties in which a significant amount of a lubricant is adhered to the surfaces of the fibers.

These improved fibers are made by the process comprising spreading at an elevated temperature onto the fibers a substantially non-tacky wettable lubricant as a mixture, emulsion or solution in water, followed by a pressure application means and subsequently heating the fibers at an elevated temperature for time sufficient to dry or bake the lubricant onto or into the surface of the fibers. Fibers made by this process are particularly useful in making nonwoven materials.

Another aspect of this invention entails novel fiber processing lubricants comprising a mixture of high and low molecular weight polyethylene glycol fatty acid esters preferably in combination with a minor amount of a suitable antistatic agent. In some applications, this novel lubricant or mixture can be applied to the fibers of choice at about room temperature by various means as a less preferred option.

Yet another aspect of this invention entails a novel hydrophilic processing lubricant for use with fibers, particularly binder fibers, comprising a mixture of a suitable antistatic agent and at least one polyethylene glycol monolaurate or monostearate having a sorbitan group such as polyethylene glycol 880 sorbitan monolaurate and/or polyethylene glycol 880 sorbitan monostearate.

BRIEF DESCRIPTION OF DRAWINGS

FIG. 2—Schematic representation of examples of fiber cross-sections of preferred non-round spun fibers having a plurality of grooves.

DETAILED DESCRIPTION OF THE INVENTION

Figure 1:
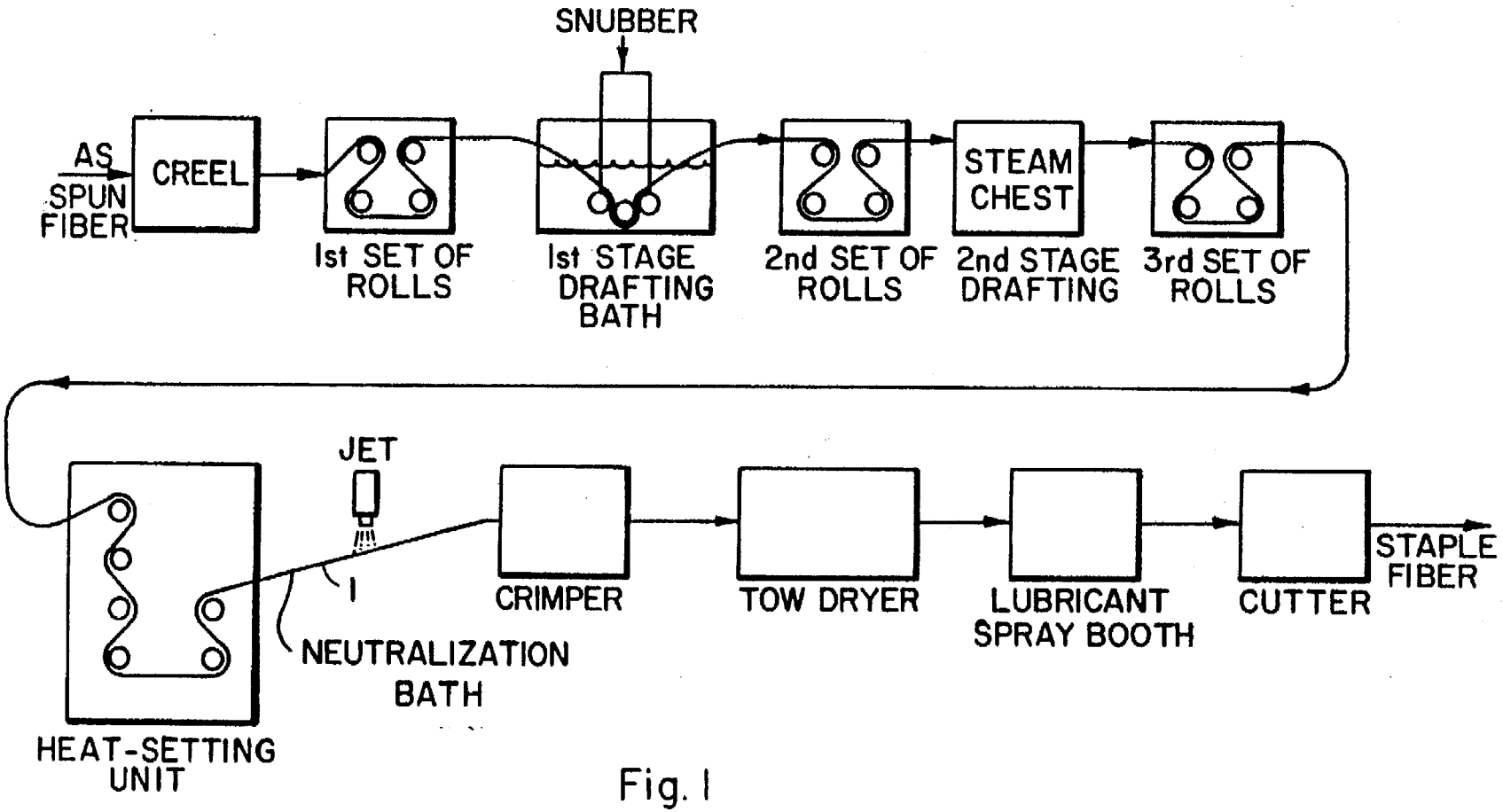
FIG. 1—Schematic flow chart of a preferred tow-processing operation within the scope of the present invention. The solution of heated processing lubricant is preferably applied by at least one jet immediately prior to the crimper. At least one component of a lubricant and/or a cross-linking agent can be applied prior to the heat-setting unit.

Fibers produced according to the process of the present invention, particularly those having at least one continuous groove, having either round or grooved cross-section, are characterized by an unexpected combination of desirable properties including fiber opening, card-web quality, cohesiveness, good textile and nonwoven processability, hand, and bonding properties. In addition the liquid-transport capabilities are at least as good as and in some instances possibly better than those of comparable fibers that are not treated according to the process of the present invention. The liquid-transport capability is more durable in that, after vigorous scouring such as with hot water for many seconds as later described, these treated fibers and products made therefrom (at least when caustic treated) unexpectedly (1) retain effective amounts of certain lubricants and (2) more importantly, provide greater liquid-transport durability than comparable non-treated fibers/products.

In particular, these novel fibers can be efficiently conducted through nonwoven processes with subsequent bonding and/or calendering processes, as appropriate to provide hydrophilic fabrics which have excellent cover, softness, hand and/or overall properties compared to untreated fiber.

If desired, the process of the present invention also eliminates the need for steam application prior to the crimper; however, steam heating is a viable, yet less desirable, option for heating the novel lubricant mixture.

Any method of applying the processing lubricant to sufficiently coat the fibers, including the grooves, that also softens the fibers just prior to the crimper is envisioned to be within the scope of the present invention.

A preferred process of the present invention comprises:

(A) contacting at an elevated temperature at least one fiber with a sufficient amount of a solution containing a sufficient amount of at least one substantially non-tacky non-static hydrophilic (wettable) processing lubricant to coat said fiber;

(B) crimping at an elevated temperature the lubricant-coated fiber of (A); and (C) heating the thus crimped lubricant-coated fiber of (B) at a sufficient temperature for a sufficient time to dry or bake said lubricant onto and/or into the surface of said fiber.

A more preferred process of the present invention comprises:

(A) coating at least one caustic-treated non-round fiber with at least about 0.1 weight % and most preferably at least about 0.3 weight % of at least one substantially non-tacky, wettable, processing lubricant with antistatic properties at a temperature between about 40° C. and the boiling point of the lubricant to coat said fiber;

(B) crimping at an elevated temperature the lubricant-coated fiber of (A); and (C) heating the thus crimped lubricant-coated fiber of (B) at a temperature between 40° and 180° C. for sufficient time to dry or bake the lubricant onto and/or into the surface of said fiber.

The mixture, solution or emulsion of processing lubricant preferably contains at least about 5 wt. % processing lubricant, more preferably at least about 10 wt. % with about 20 wt. % being most preferred. The solution should be relatively free-flowing in that when heated to at least 40° C. it can spread and flow readily when it is placed on a glass surface angled at 30° from horizontal. To avoid being too viscous the solution preferably contains less than about 40 wt. % lubricant, more preferably less than about 30 wt. %.

The resulting novel fibers are preferably coated with at least 0.1 wt. % lubricant based on the total wt. % of the fiber and lubricant and more preferably at least about 0.2 wt. % lubricant with at least about 0.3 to 3 wt. % lubricant being most preferred.

Not all lubricants are suitable for use in the present invention. We have found that commonly-used processing lubricants, such as potassium lauryl phosphate and mineral oil types even applied according to the process of the present invention, at low and particularly high levels, are not suitable for use with liquid-transport fibers, particularly the caustic-treated non-round fibers described hereinafter. It is believed that the unsuitability of these lubricants is due to their relative hydrophobic nature. In addition, however, not all hydrophilic lubricants are suitable. Suitable hydrophilic lubricants must also create at least a certain minimum level of cohesion or fiber-to-fiber friction without being excessively "tacky" or "sticky" when dried as hereinafter described.

The processing lubricant must be substantially non-tacky when dried. In other words, when the lubricant is coated and dried on a surface, that coated surface should not easily adhere or "stick" to other non-tacky surfaces. The fibers coated with the dried-on or baked-on non-tacky lubricant should not be sticky and should be cardable and capable of being efficiently separated (opened). These fibers should card without wrapping, or "loading" the main carding cylinder or other carding components and should produce carded webs which have sufficient strength for subsequent operations.

The processing lubricant should also act as a surfactant and be wettable or somewhat hydrophilic and mix with solutions, emulsions or mixtures containing hot water although the processing lubricant could, if desired, be applied to fibers in a non-aqueous solution. When this lubricant is dried on a surface, such as a thin film of plastic, it should spread or disperse water droplets that touch the surface. This processing lubricant should enhance the liquid-transport properties of a fiber, once it is dried or baked onto and/or into the surface of the fiber.

Additionally, the processing lubricant should be of a substantially low-static nature and/or allow for at least satisfactory control of static. This lubricant should control static either alone or in the presence of a minor amount of at least one antistatic agent.

Antistatic agents useful in the present invention include quaternary amine salts, salts of polyoxyethylene inorganic fatty alcohol esters, ethosulfate salts of quaternary ammonium compounds, acid salts of quaternary ammonium compounds, etc. The preferred antistatic agents are the salts of quaternary ammonium compounds including the ethosulfate salts and acid salts such as the acetates, lactates, and propionates with the ethosulfate salts being more preferred. The most preferred ethosulfate salt of a quaternary ammonium compound is 4-ethyl, 4-cetyl, morpholinium ethosulfate.

The processing lubricant of the present invention is preferably at least partially water soluble and is not too viscous when in solution with water under the conditions when applied to the fibers. The lubricant of the present invention can contain a major portion of a polyoxyethylene fatty acid ester such as a methyl-capped polyoxyethylene laurate; a polyethylene glycol fatty acid ester such as a polyethylene glycol laurate; or a fatty acid glyceride such as a glyceryl oleate. The processing lubricant of the present invention can also contain an amount of a compatible surfactant and/or softening agent. By compatible it is meant that this component would not cause an adverse reaction such as gelling, coagulation, precipitation, etc.

The processing lubricant is preferably selected from (A) a mixture of a major amount of a methyl-capped polyoxyethylene (x) fatty ester (x represents about 2 to 50 moles of ethylene oxide and the fatty ester contains 7 to 18 carbon atoms such as laurate), and a minor portion of quaternary amine carbonate or other suitable antistatic agent; and (B) a mixture of a major portion of at least one polyethylene glycol mono or dilaurate (molecular weight between about 80 and 2,000 with 400–600 being more preferred) and, if needed, a minor amount of a suitable antistatic agent with the mixture (B) being the most preferred processing lubricant.

The mixture (A) preferably contains about 55 to 80 % by wt. of a methyl-capped polyoxyethylene (x) laurate wherein x represents about 2 to 50 moles of ethylene oxide.

According to another aspect of the present invention, an improved lubricant mixture is provided that generally falls within (B) above containing low and high molecular weight polyethylene glycol fatty acid esters such as polyethylene glycol 400 monolaurate and polyethylene glycol 600 monolaurate plus a minor amount of a suitable antistatic agent, such as 4-ethyl, 4-cetyl, morpholinium ethosulfate. By definition, a low molecular weight polyethylene glycol fatty acid ester has a molecular weight in the polyethylene glycol portion below 500. By definition, a high molecular weight polyethylene glycol fatty acid ester has a molecular weight in the polyethylene glycol portion above 500. The most preferred low molecular weight polyethylene glycol fatty acid ester is polyethylene glycol 400 monolaurate and the most preferred high molecular weight polyethylene glycol fatty acid ester is polyethylene glycol 600 monolaurate. This novel lubricant mixture is much preferred for use in the present invention and preferably comprises a major portion of substantially equal portions of the low molecular weight polyethylene glycol fatty acid ester and the high molecular weight polyethylene glycol fatty acid ester and a minor amount of a suitable antistatic agent, such as 4-ethyl, 4-cetyl, morpholinium ethosulfate. These components can be obtained from Henkel Corporation or ICI Americas Corporation.

The novel lubricant mixture most preferably contains at least about 40 weight percent of the low molecular weight polyethylene glycol fatty acid ester, at least about 40 weight percent of the high molecular weight polyethylene glycol fatty acid ester and about 20 to 1 weight % of a suitable antistatic agent with 4-ethyl, 4-cetyl, morpholinium ethosulfate being the preferred antistatic agent.

Other preferred lubricants, particularly for use with binder fibers, include a major portion of at least one polyethylene glycol monolaurate or monostearate having a sorbitan group such as polyethylene glycol 880 sorbitan monolaurate and/or polyethylene glycol 880 sorbitan monostearate mixed in water with a minor portion of a suitable antistat. This novel lubricant most preferably contains (excluding water) at least about 80 weight % polyethylene glycol 880 sorbitan monolaurate and/or polyethylene glycol 880 sorbitan monostearate and about 1 to 20 weight % of a suitable antistat with 4-ethyl, 4-cetyl, morpholinium ethosulfate being most preferred.

A binder fiber is a material substantially in fiber form, such as crimped staple which is blended as a minor component with a more stable, heat-resistant major component fiber, which can be heated and compressed to form a bonded nonwoven fabric.

The solution of lubricant can, if found to be appropriate for a particular need, contain minor amounts of at least one other additive, such as a coloring agent, aroma-enhancing agent, scouring agent, anti-fungal or anti-bacterial agent, defoamer, additional antistatic agents, other hydrophilic components, a friction-modifying agent, a super-absorbent powder or polymer, fluorescent additive, antiseptic additive, additives suitable for cosmetic purposes, ethoxylated oleyl alcohol (cosmetic grade, etc.). Such other additive can be applied, as an option, to the final nonwoven or textile product. As appropriate and feasible, suitable components of our novel lubricants can be modified, such as by methyl-capping, etc. The processing lubricant can, if applied in a separate step, contain a cross-linking agent with or without a catalyst and/or additives which have bonding properties. An example of a suitable cross-linking agent is LUREEN 2195, a hydrophobic cross-linking silicone from G. A. Goulston Co. Examples of suitable friction-modifying agents are a polyoxyethylene-polyoxypropylene condensate, such as PLURACOL V-10 and various fatty acid (C10–C18) diethanolamide condensates, such as made by Emery Chemical Co.

The processing lubricant can also contain minor or trace amounts of additives useful in the processing of fibers such as spinning lubricant, polymer, chemicals useful in dyeing, etc. and mixtures thereof.

The processing-lubricant solution solvent is preferably selected from the group consisting of water, water containing a minor amount of acetone, ethanol or other solvents, water containing minor amounts of reaction products or materials washed from the fiber, etc. and mixtures thereof with plain or distilled water being more preferred.

Although the present invention is an improvement over the art, not all lubricants, including the novel lubricants, perform equally well on all fibers. The most preferred suitability must be determined on a case-by-case basis matching fiber and specific lubricant.

Additionally, the novel lubricants can be applied as appropriate to plastic tapes, ribbons, films and other manufactured articles.

Figure 6:
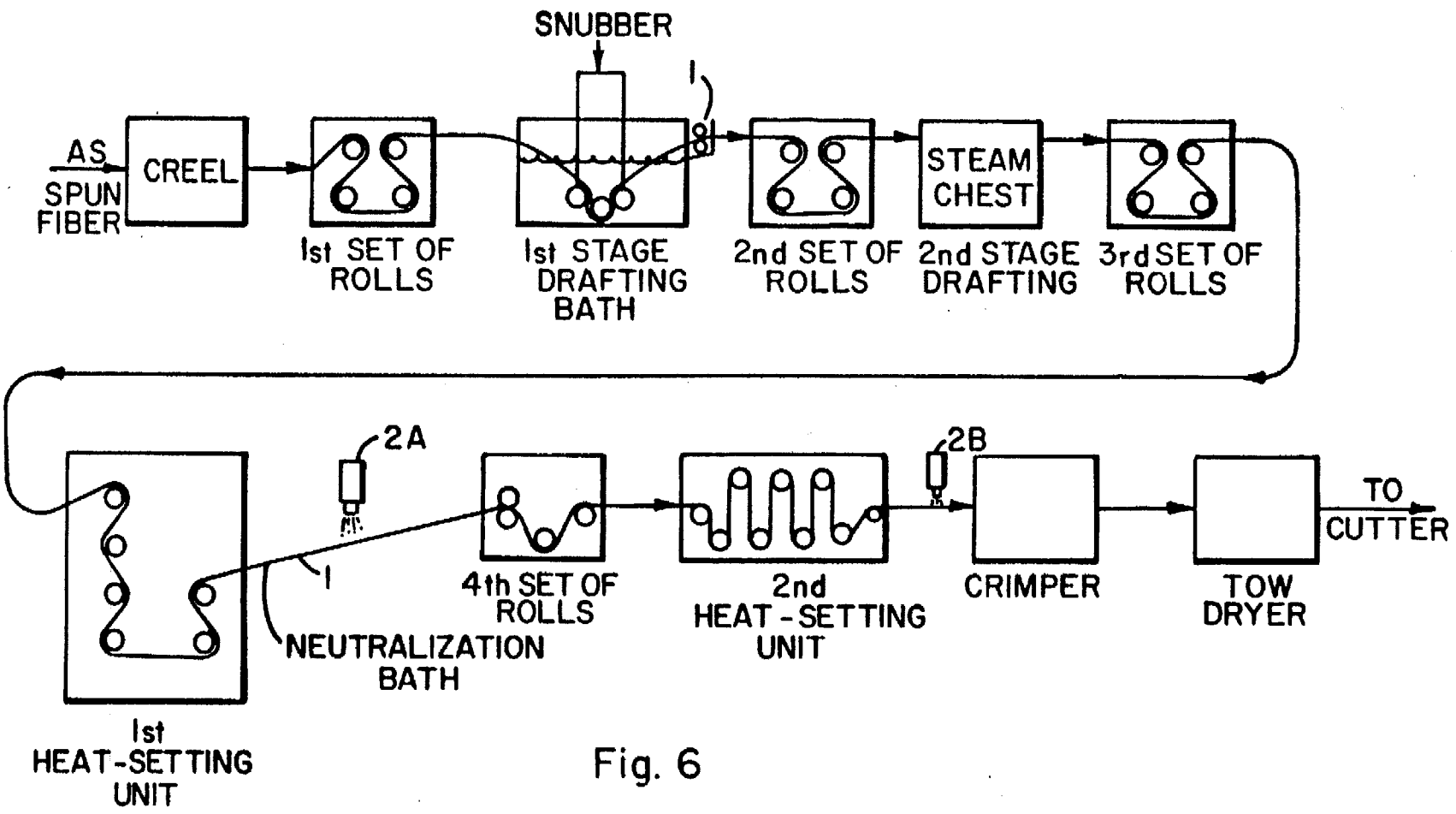
FIG. 6—Schematic flow chart of a most preferred tow processing operation within the scope of the present invention. Excess liquid is removed by at least a Partial Liquid Removal Means 1 following both the drafting bath and the neutralization bath and the tow is sufficiently dried prior to being contacted by the heated solution of processing lubricant at 2B immediately prior to crimping. Additional or alternate processing-lubricant application means, treatment, and/or neutralization means are illustrated at 2A. If an additional means is utilized at 2A, then the tow is substantially dried prior to being contacted by the heated solution of processing lubricant at 2B. Squeeze rolls are shown at the input to the 4th set of rolls.

Prior to the application of the lubricant the fibers of the present invention are preferably caustic treated, such as by a caustic solution at an appropriate concentration followed by neutralization. This caustic treatment is most preferably conducted prior to application of the hot processing lubricant solution as shown in FIGS. 1 and 6. This caustic treatment is preferably conducted by the following steps: (1) caustic treating the fiber, (2) heating the fiber, and (3) substantially neutralizing excess caustic using a suitable acid solution (such as acetic or citric acid). This heating step is preferably conducted at a temperature of at least about 130° C., more preferably at a temperature of at least about 145° C. for approximately 2 to about 25 seconds. Of course, this temperature should not be so high as to melt the fiber or degrade the lubricant. The suitable acid used in the neutralizing step is preferably selected from the group consisting of acetic acid, citric acid, ascorbic acid, and/or mixtures thereof. The process of the present invention in combination with this caustic treatment or surface hydrolysis results in novel fibers which have unexpectedly a superior combination of important characteristics including processability, liquid-transport, and/or overall performance compared to other fibers not treated by caustic and an appropriate amount of the novel hot-lubricant prior to crimping.

The present invention is most preferably directed to caustic-treated and neutralized fibers with suitable non-round cross-sections having longitudinal grooves that are substantially continuous in which a significant amount of a hydrophilic processing lubricant is adhered to the surfaces of the fibers and a significant amount remains after a hot-water treatment as described. These fibers have improved overall performance including processability. However, the novel process of this invention can be used to improve the crimp formation, cohesion, processability and overall performance of fibers not treated with caustic.

Fibers with many longitudinal or axial grooves tend to hold liquid, such as neutralization solution, in the grooves and do not permit sufficient lubricant to enter. Therefore, it is important to remove this excess liquid prior to contacting the fibers with the heated processing lubricant so that the grooves are substantially devoid of liquid. This can be accomplished by a partial or total liquid removal process in which at least one liquid removal means, such as bars, squeeze rollers, and/or air jets physically removes a significant portion of the liquid. For substantially total liquid removal this physical removal must be followed by drying at elevated temperatures prior to the application of the heated processing lubricant. FIG. 1 illustrates the location of Liquid-Removal Means 1 that can be employed following the 1st stage drafting bath and/or after the optional neutralization bath to at least partially remove liquid from the tow.

The fiber is contacted with a continuous flow or semi-continuous pulsed flow of the solution of processing lubricant at an elevated temperature, preferably at a temperature of at least about 40° C. up to the boiling point of the solution. This temperature is more preferably between about 50° and 100° C. with a temperature less than about 95° C. being most preferred. For drawn polyesters this most preferred temperature is between about 70° and 95° C. For binder fibers, such as copolyesters and undrawn polyesters, the preferred temperature is between about 40° and 70° C.

Figure 4:
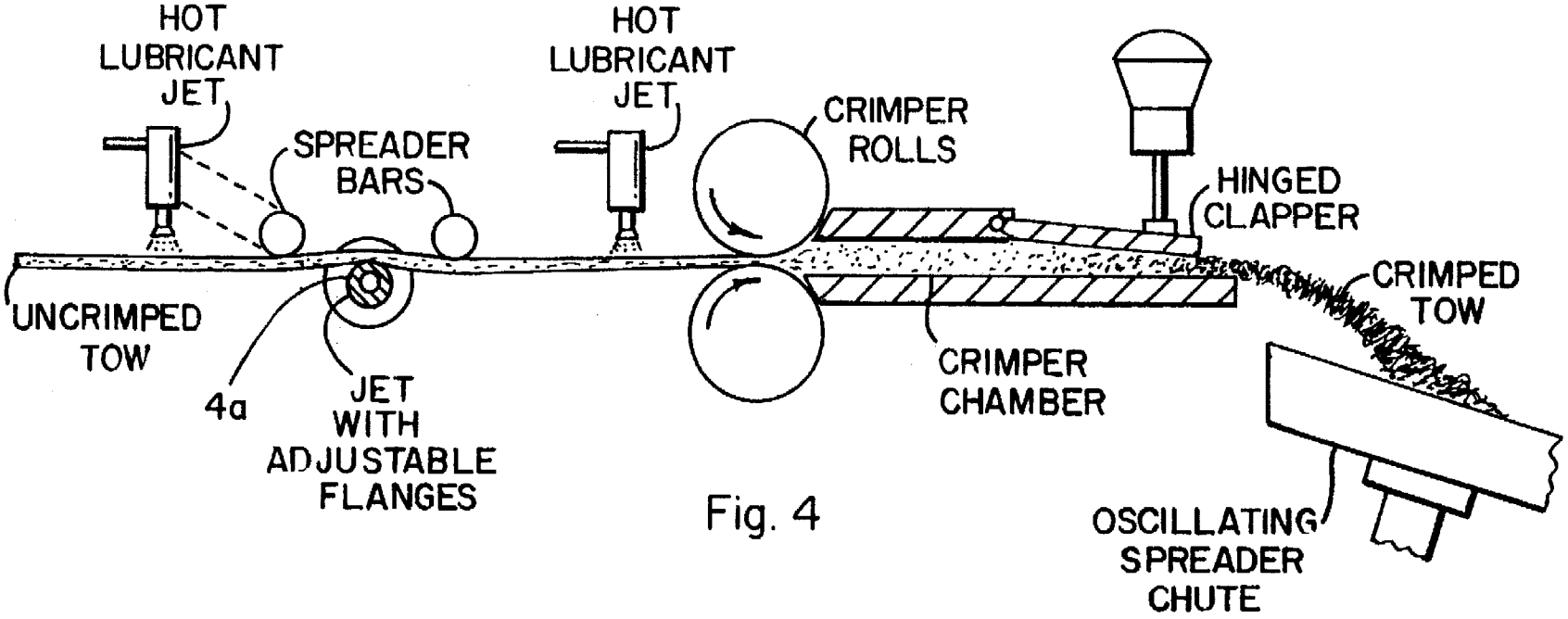
FIG. 4—Detail of a most preferred method of applying the hot solution of processing lubricant to the fibers of a tow prior to crimping. The crimper is a stuffer-box type crimper with advancing rollers or can be any suitable type of crimper.
Figure 4A:
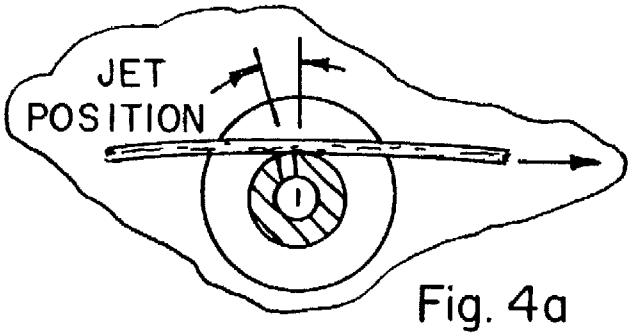

The application of the hot processing-lubricant solution can be conducted in any suitable manner so long as substantial loss of heat is avoided (such as by fine droplet formation) and a sufficient amount of the processing lubricant is coated on the surface of each of the fibers. That amount should preferably be sufficient to maintain satisfactory crimp formation, cohesion and processability. A much preferred process of applying this hot lubricant solution is by the use of one or more jets positioned just prior to crimping such as shown in FIG. 4. This figure illustrates the use of both top and bottom jets to facilitate penetration of the hot lubricant into the center of the fiber bundle (tow). It is important that, as far as it is practical, hot lubricant contacts each fiber so as to heat and soften each fiber. Therefore, during or after contacting of the fiber with the continuous flow of processing lubricant, an elevated temperature is maintained as the lubricant is spread in a substantially uniformly manner onto the fiber. A subsequent crimping or compression means (such as a crimper or compression roll) is the preferred method used to spread the lubricant and press it into the grooves of the fiber. Additionally, thoroughly coating the fibers with the proper lubricant, such as the most preferred of mixture (B) (heated lubricant-antistat), helps protect the fibers against damage during the crimping process.

It is also preferred to spread the lubricant onto the fiber to a certain extent during and/or immediately after application of the lubricant prior to any crimping means. The lubricant can be spread by any conventional means but is preferably spread by a spreader bar, compression rolls, and/or a hot lubricant application jet in the shape of a spreader bar as shown in FIG. 4. These spreading means are also preferably vibrated.

To avoid scuffing or other damage to the fiber, the fiber should not contact a dry jet surface. When a jet contacts the fibers, the slot or jet holes are most preferably located in a curved contact surface oriented towards the advancing fiber as shown in FIG. 4 to minimize dry contact between the tow and the bar in order to prevent scuffing or otherwise damaging the fiber as far as practical. Thus, FIG. 4 illustrates a novel and much preferred application means for hot lubricant, particularly where at least one spreader bar is suitably mounted and equipped with vibration means to facilitate fiber separation and lubricant penetration into the tow band to coat the fibers more uniformly. As an option, the bottom jet or jets can be spaced from the tow and can apply heated lubricant at sufficient pressure to impinge upon the tow. Appropriate supply tank, stirring means, heating means, pumping means, reconstitution means, housing, drains and recirculation would be provided.

The use of hot-lubricant jets in series prior to the crimper on the tow processing line is illustrated in FIGS. 4. The tow is maintained under appropriate tension between the last roll and the crimper and, as stated above and illustrated in FIG. 4, the slotted jet is oriented to prevent contact of the tow with a "dry" (unlubricated) surface (such as metal or ceramic) which could cause damage to the fiber (fused fibers, broken filaments, "skin-backs", etc.). A series of small holes can be substituted for the slot, if desired. The adjustable flanges hold the tow in proper position and cover the slot or holes at the tow edges as required for various tow widths. This bottom jet with either a slot or holes can be constructed with multiple lubricant-supply chambers oriented across the tow band. FIG. 4 illustrates the multi-jet application means which is a most preferred embodiment of the present invention. In order to provide for adjustment of the % lubricant applied and/or lubricant concentration used for any given fiber type, facilities can be provided to permit each jet to be operated, adjusted or disconnected independently from the others. In a most preferred embodiment, at least one of the two top jets has a common mount and/or support member with at least one of the spreader bars such that the top jet and bar can be pivoted or elevated by any suitable means to provide convenient access to the tow path during start-up when the tow is placed in the crimper rolls. One embodiment of this common mount and/or support member is illustrated in FIG. 4 by the broken lines. The first (upstream) jet applies heated lubricant on top of the tow band. The lubricant forms a surprisingly stable, small concentration (bead) at the input side of the first spreader bar. This spreader bar spreads the lubricant from the first jet and causes penetration into the tow, thus increasing the uniformity of lubricant application (a top jet similar in design to the bottom jet could also be used to replace the top jet and/or spreader bar). Lubricant applied by the bottom jet is pushed upward into the tow by the rounded top portion of this jet. An optional spreader bar (not shown) located beneath the tow can be located downstream from the bottom jet and can have a common mount and/or support member with the bottom jet. The last (downstream) top jet can apply additional lubricant which forms a small bead on top of the tow at the crimper input to be forced into the tow by the crimper rolls. The bottom jet can be operated in combination with one of the top jets. This novel multi-Jet lubrication means should be located as close to the crimper input as is practical preferably within about 90 inches (about 225 cm) most preferably within about 60 inches (about 150 cm) of the crimper with the closest jet most preferably located less than about 24 inches (60 cm) from the crimper. It is preferred that the distance from the first jet to the third should not exceed about 6 feet (180 cm).

Appropriate insulation can be used to help maintain the lubricant in a heated condition. In addition, the jet(s) can be designed with a novel circulation system (not shown) such that only a portion of the lubricant exits the jet(s) and is being constantly applied to the tow while the remainder of the lubricant is returned to be reheated in the heated supply tank in a semi-closed loop. This recycling of lubricant should help keep the lubricant hot and also avoid plugging of the jet. The heated supply tank can be equipped with automatic monitoring and correction systems for lubricant concentration, temperature sensors, insulation, etc. as needed to facilitate uniform application of heated lubricant.

A less preferred embodiment is similar to FIG. 4 except a lubricant-coated, rotating, tow-contact roll which is partially immersed in a bath of heated lubricant is substituted for the bottom slotted jet. This embodiment is much less preferred because it is more complex, would tend to contaminate the lubricant and is more difficult to insulate.

A less preferred option is the application of the most preferred lubricant in the neutralization bath followed by a removal means for excess liquid and a heating means prior to the crimper.

An even less preferred option is the application of the most preferred novel lubricant mixture by conventional means followed by a steam chamber to heat the fiber and applied lubricant followed by crimping and heating in a tow dryer unless contact means, such as spreader bars or rolls are included to increase the penetration of the lubricant into the grooves of the fibers.

Another less preferred option, although an improvement over the art, is the application of a most preferred novel lubricant after the crisper and tow dryer in the conventional manner. Mowever, the opportunities to force heated lubricant onto and into the grooves of the fibers; to enhance crimp formation; and to help protect the fiber surfaces during passage through the crimper are lost. It is believed that, if a conventional application of steam is used prior to crimping, the novel lubricant composition even though applied by conventional means, can be used to facilitate, to a certain extent, the processability of the fiber through nonwoven or textile machinery and to make some improvement in overall performance. Such conventional application means can include immersion baths, spray-application means (such as by airless jets or air-powered jets, etc.), application cylinders with slot(s) or holes, electrostatic sprays, dual kiss-rolls, dual brush applicators, etc., to apply the novel hydrophilic lubricant(s) to each side of a tow band. This novel lubricant composition most preferably comprises at least about 45 weight % polyethylene glycol 400 monolaurate, at least about 45 weight % polyethylene glycol 600 monolaurate and up to 10 weight % 4-ethyl, 4-cetyl, morpholinium ethosulfate.

According to the process of the present invention, the fibers containing the coating of heated processing lubricant must be treated to a drying step such as heating in the tow dryer. This tow dryer should be equipped with an air circulation system. This completes the attachment of the processing lubricant securely to the surface of the fibers, particularly to the surface in the grooves of non-round fibers and more particularly caustic-treated grooves. The overall heating or drying time is preferably less than about 7 minutes and more preferably less than about 4 minutes. This drying step is preferably conducted at a temperature of at least about 40° C. more preferably between 50° C. and 135° C. for at least about 20 seconds; even more preferably between 50° C. and 115° C. for at least 90 seconds with at least 180 seconds being most preferred. For acetate fibers and drawn polyester fibers this more preferred temperature is between about 60° C. and 115° C. For binder fibers such as copolyesters and undrawn polyesters this temperature is between about 40° C. and 70° C. However, it is understood that changes in drying temperature may be required in order to meet different end uses. When caustic is not used or when appropriate for a particular product, the heat-set cabinet can be operated at or near room temperature, if desired, with essentially all of the tow drying treatment being accomplished in the tow dryer.

The thus heated, lubricant-coated fiber, when appropriate, also can be heated a second time. This second heating temperature is preferably at least about 10° to 60° C. higher than the first tow dryer section. The contacting time for this second heating is at least about 5 seconds. This second heating is preferably conducted at a temperature of at least 135° C. for at least about 5 seconds; preferably over 10 seconds with over 20 seconds being most preferred. This second heating or tow drying step can also be conducted at a temperature of at least 175° C. for at least about 2 seconds. The heating conditions used should be appropriate for the type of nonwoven or textile processing used and the performance characteristics required for the eventual product.

We believe that most all types of synthetic fibers could be benefited, to some extent, by being treated according to the process of the present invention. Examples of suitable fibers that can be treated according to the present invention include those selected from the group consisting of polyesters including copolyesters, cellulose acetate, modacrylic, nylon, olefins, viscose rayon, polyphenylene sulfide, fibers made from biodegradable materials, and suitable mixtures or blends thereof. The preferred fibers that can be treated according to the present invention are polyesters, cellulose acetate, modacrylic, nylon, and viscose rayon with polyesters and cellulose acetate being most preferred. The preferred polyesters including copolyesters are selected from relatively oriented polyesters, relatively unoriented polyesters, polyesters modified for basic dyeability, polyesters containing starch, polyesters containing cellulose acetate, polyesters containing cellulose propionate, polyesters containing cellulose butyrate, polyesters containing modified starch (such as starch acetate) and aliphatic polyesters blended with cellulose esters. In addition, polyesters which have been modified chemically or by a polymerized exterior coating can be benefitted by being treated according to the process of the present invention.

The cellulose acetate fibers useful in the present invention are prepared by melt-spinning or conventional solvent-spinning means using acetone as a solvent. The cellulose acetate can contain additives which further enhance hydrophilic action and/or other desired properties.

The polyester materials useful in the present invention are polyesters or copolyesters that are well known in the art and can be prepared using standard techniques, such as, by polymerizing dicarboxylic acids or esters thereof and glycols. The dicarboxylic acid compounds used in the production of polyesters and copolyesters are well known to those skilled in the art and illustratively include terephthalic acid, isophthalic acid, p,p'-diphenyldicarboxylic acid, p,p'-dicarboxydiphenyl ethane, p,p'-dicarboxydiphenyl hexane, p,p'-dicarboxydiphenyl ether, p,p'-dicarboxyphenoxy ethane, the like, and the dialkylesters thereof that contain from 1 to about 5 carbon atoms in the alkyl groups thereof.

Suitable aliphatic glycols for the production of polyesters and copolyesters are the acyclic and alicyclic aliphatic glycols having from 2 to 10 carbon atoms, especially those represented by the general formula $HO(CH_2)_pOH$, wherein p is an integer having a value of from 2 to about 10, such as ethylene glycol, trimethylene glycol, tetramethylene glycol, pentamethylene glycol, decamethylene glycol, and the like.

Other known suitable aliphatic glycols include, 1,4-cyclohexanedimethanol, 3-ethyl-1,5-pentanediol, 1,4-xylylene, glycol, 2,2,4,4-tetramethyl-1,3-cyclobutanediol, and the like. One can also have present a hydroxylcarboxyl compound such as 4,-hydroxybenzoic acid, 4-hydroxyethoxybenzoic acid, or any of the other hydroxylcarboxyl compounds known as useful to those skilled in the art.

It is also known that mixtures of the above dicarboxylic acid compounds or mixtures of the aliphatic glycols can be used and that a minor amount of the dicarboxylic acid component, generally up to about 10 mole percent, can be replaced by other acids or modifiers such as adipic acid, sebacic acid, or the esters thereof, or with modifiers that impart improved dyeability or dyeability with basic dyes to the polymers. In addition one can also include pigments (such as blanc fixe), delusterants (such as $TiO_2$) or optical brighteners by the known procedures and in the known amounts.

The most preferred polyesters for use in the present invention are (1) relatively unoriented and relatively oriented poly(ethylene terephthalate) (PET); (2) copolyesters based on poly(ethylene terephthalate), particularly those suitable for use as binder fibers, (3) poly(ethylene terephthalate) containing cellulosic additives and/or modified starch, such as starch acetate, and (4) cellulose acetate fibers.

Figure 2A:
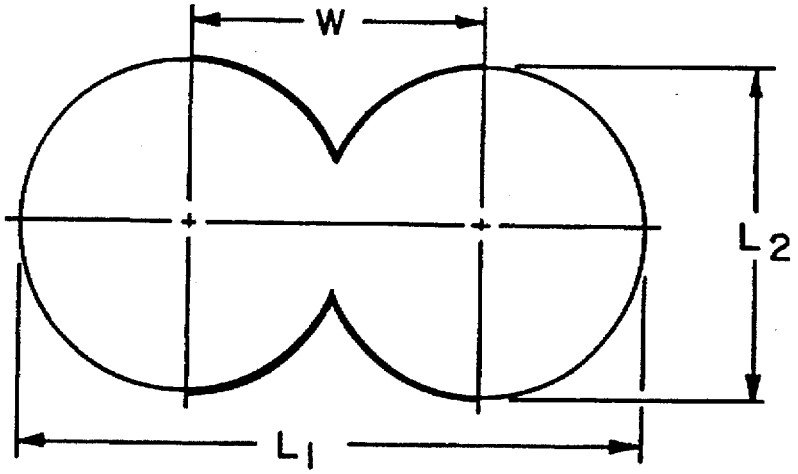
FIG. 2*a* is a representation of a more preferred cross-section with two grooves and is particularly useful for deniers less than about 5.0. L1 is a major axis; L2 is a minor axis, W is the width of the groove; thicker lines represent the surfaces of the grooves; and the thinner lines represent the surfaces outside the grooves.
Figure 2B:
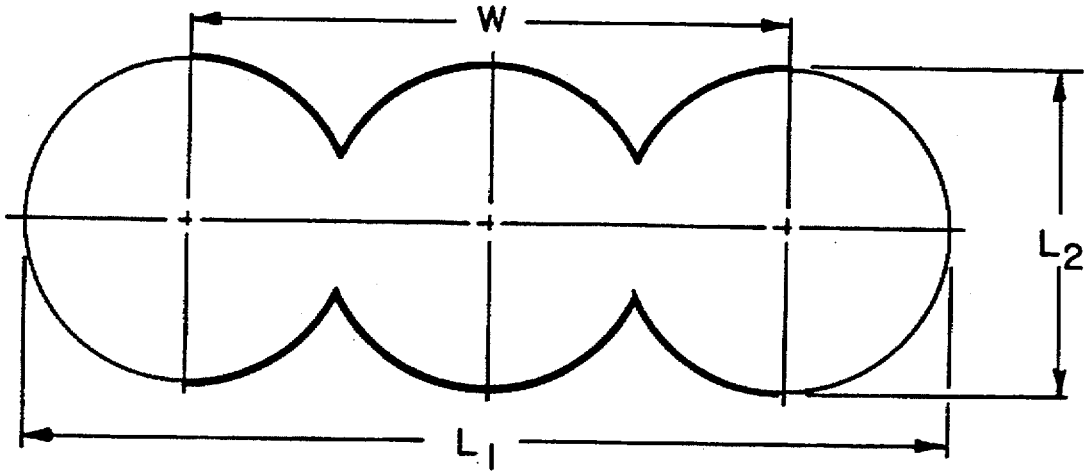
FIG. 2*b* illustrates a cross-section which has four grooves.
Figure 2C:
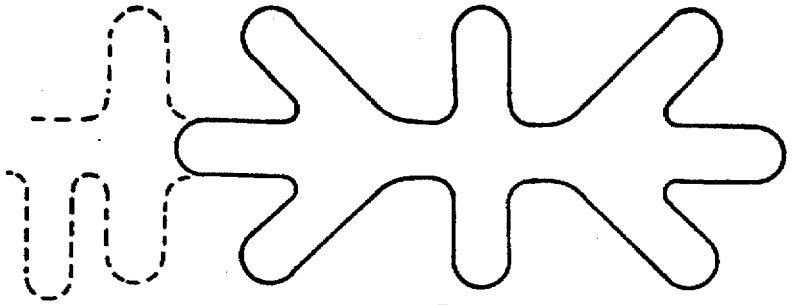
FIG. 2*c* illustrates various cross-sections which have continuous grooves.
Figure 2D:
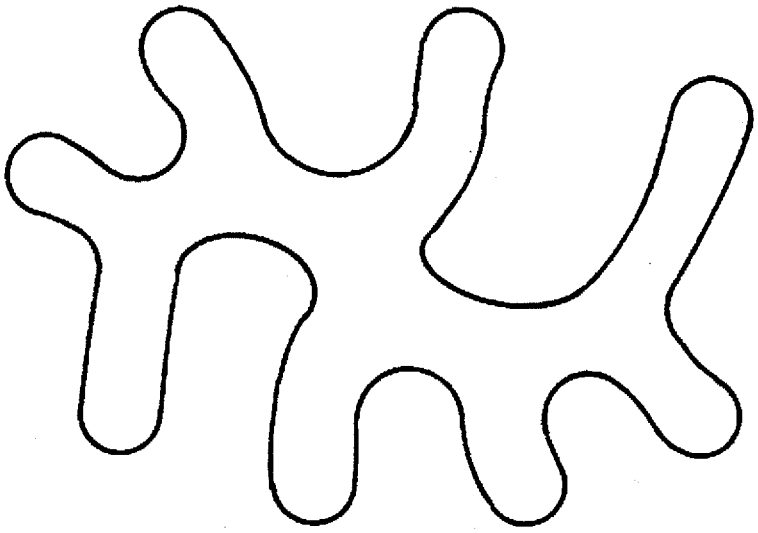
FIG. 2*d* represents the general form of a much preferred eight-groove cross-section which is useful for deniers greater than about 5.

The fibers of the present invention are preferably non-round fibers having at least one continuous groove such as those disclosed in U.S. Pat. No. 4,842,792, and U.S. Pat. No. 4,954,398 the disclosures of which are incorporated in their entirety herein by reference. The surface of the groove is most preferably rougher than the surface outside the groove. Examples of various fiber cross sections are illustrated in FIGS. 2*a*, 2*b*, 2*c* and 2*d*. FIGS. 2*a* and 2*d* are the more preferred cross sections treated according to the present invention. It is believed, however, that the overall performance of any non-round fiber in crimped staple form will be improved by the process of the present invention, particularly those which have well-defined grooves and/or channels as shown. The broken lines to the left of 2*c* are included to illustrate various alternative designs and/or additions to the basic design. The grooves could also be arranged in a circular pattern around a solid or hollow core. The preferred non-round fiber has at least 1 up to 30 or more grooves and/or channels and/or legs which are substantially continuous. Fibers having a plurality of grooves have a larger surface area per unit weight than round fibers and thus can be coated with more lubricant. Fibers having at least one continuous cross-sectional groove preferably have at least about 0.3 wt. % lubricant coated on their surfaces whereas fibers having five or more grooves have at least about 0.5 wt. % lubricant coated on their surfaces.

A preferred fiber form useful in the process of the present invention is a tow of continuous filaments of between about 10,000 up to at least 100,000 total denier. However, tows of much greater denier can be used also. This tow as with other tows (crimped or non-crimped) can be processed through a tow feeder after the tow dryer (skipping the cutter) and collected in a baler to form bales which are convenient for shipment. The tow subsequently can be opened or spread by rolls and/or jets and thereafter used in various nonwoven products, filters, etc. For staple fibers, the total tow denier can be as small as 30,000 and as large as at least 2,000,000. It is also preferred that the fiber of the present invention be subjected to crimping immediately after being contacted and spread with the heated solution of processing lubricant. The preferred crimped or non-crimped fiber has a staple length of about 0.5 cm to about 15 cm and/or a denier per filament of about 0.7 to 200.

The process of the present invention preferably entails contacting a group of fibers arranged in a relatively flat band (drawn or undrawn tow) with at least one of certain processing lubricants at an elevated temperature; causing the processing lubricant to penetrate into the tow to coat the fibers; subsequently subjecting the tow to pressure via driven rolls followed by heating the tow at a temperature for a time sufficient to bake or dry said lubricant onto and/or into the surface of the fibers. The driven rolls can be the rolls of a crimper.

The treated fibers in the form of tow, crimped staple or uncrimped staple can be subsequently blended or combined with at least one other tow or staple fiber (such as a binder fiber); subjected to suitable nonwoven processing to form a web with the web being subsequently heated and appropriately compressed to cause the blended fibers to compress and bond so as to produce a bonded, nonwoven material, such as a fabric or batting.

A most preferred process of the present invention entails (1) subjecting a tow of caustic-treated and subsequently-neutralized polyester fibers as described to a heating device, most preferably rotating heated drums with tow-temperature controls and/or moisture sensors following an at least partial removal of water after the neutralization step and an optional application of at least one lubricant and/or additive; (2) forwarding the dried tow from the heating device at a tension suitable for proper crimping; (3) applying at least one heated processing lubricant to the dried tow; (4) crimping the fibers or applying rotating compression rolls to the fibers (preferably immediately after applying lubricant); and (5) heating the tow at a temperature for a time sufficient to bake or dry the lubricant onto and/or into the surface of the fibers.

The temperature range for the tow dryer is important with regard to maintaining the desired crimp angle. For example, a tow of crimped fiber after being dried in the tow dryer for 5 minutes at 75° C. could have a well-formed, relatively sharp average crimp angle of about 65 to 80 degrees (by estimation method). However, this same fiber would have successively wider, more open, more rounded, crimp angles, if it had been dried at 135°, 150° and 175° C. for the same length of time. Assuming no change in hydrophilic lubricant, the increasingly more open crimp angles create an increasing tendency toward reduced fiber cohesiveness. Thus, the cohesiveness required for proper performance of a given fiber in a particular nonwoven or textile operation must be considered and the temperature of the tow dryer is one of the factors which must be taken into account.

The fiber strength (tenacity), fiber elongation, percent shrinkage, etc., required for a particular product must be considered in determining the temperatures and/or dwell times used before and/or after the crimper.

It has also been found that certain amounts of lubricant can be lost during passage through the tow dryer and/or bonding oven depending upon temperature and time. Thus the amount of lubricant applied to the fiber must be sufficient to compensate for these losses and meet the target level established for the final product, such as a bonded hydrophilic nonwoven.

Overall, it is clear that several factors must be considered in establishing the operating temperatures and dwell times for a given fiber. Applying lubricant (particularly the novel hydrophilic lubricants) in a heated condition prior to the crimper as described provides an extra margin of safety in terms of crimp formation, particularly with regard to crimp angle and apex formation.

Along with the appropriate crimp frequency, the lubricant composition, % lubricant, etc., it is most important to maintain an average crimp angle which provides sufficient fiber cohesion for at least satisfactory processing during opening, blending, carding and subsequent operations. In addition, the crimp apex should be relatively "V-shaped" instead of "U-shaped" in order to produce crimp with greater permanence. The processability characteristics of any fiber should make it possible, with a reasonable safety margin, to obtain the production rates and uniformity in opening, feeding, carding and other nonwoven or textile processes required for efficiency and profitability.

An overall cohesion value of any given sample can be quickly determined by the cohesion-test method and instrument described in U.S. Pat. No. 4,649,605 the disclosure of which is incorporated in its entirety herein by reference.

This method determines whether or not crimped staple fibers either natural or man-made, have a weighted-average cohesion number of from 5.6 to 12.5 inches (14.2 to 31.75 centimeters). This is done by initiating gas impingement contacts at successively-increasing different pressure levels against a carded web of staple fibers to cause in the carded web the formation of visible bulges until at least 90% of the bulges are eventually ruptured for a particular pressure level. At such pressure, the ruptures form "tails" blown upward by the gas impingement which equal or exceed the height of a failure-indicator bar or photocell. The pressure and number of ruptures from each pressure level are recorded and a weighted-average cohesion number is determined therefrom. The standard sliver weight used in this test is 65 grains per yard (4.59 grams per meter) but the instrument can be calibrated using other sliver weights. The laboratory is maintained at approximately 55% relative humidity at 75° F. (24° C.). The carding machine used for these tests had equipment and settings which made it possible to produce at least generally acceptable card webs suitable for test purposes using fibers with a wide denier-per-filament range of about 1.1 to 7.0 with staple lengths of about 1.25 to 2.0. The card was equipped with an autoleveller.

Cotton has relatively low cohesion compared to that which can be obtained with certain well-crimped and properly lubricated man-made fibers. Therefore, whenever possible, man-made fibers should be lubricated and crimped so as to exceed the cohesion level of cotton to a certain extent in order to obtain high carding rates (in kilograms or pounds per hour) with at least satisfactory web and sliver uniformity and strength. In view of the history of cotton, the cohesion-test instrument can be calibrated using a selected cotton to establish a desirable range of cohesion values (above those of the selected cotton). For example, cohesion tests of a blended sample from a properly-stored, aged bale of Memphis cotton with a MICRONAIRE grade of 4.6 to 4.7 (standard test for grading cotton) and an average staple length of 1 to 1.063 inches (2.54 to 2.7 cm) produced cohesion values of about 5.1 to 5.5 English (12.9 to 13.7 metric). A cohesion value is expressed in numerical terms to one decimal place without reference to the unit of measure except to note that the scale is either on an English or metric basis. Since it was known that this cotton was substantially typical in carding performance, the cohesion-test instrument was adjusted to provide cohesion values at the lower end of the cohesion range. Thus, fibers with greater cohesiveness would be expected to provide cohesion values at least somewhat higher up the cohesion range of that instrument. As an alternative, properly-aged bales of stable synthetic staple fibers with durable (relatively non-volatile) lubricants can be tested and used to establish suitable cohesion values for comparison against other fiber samples.

Tests for crimp frequency/angle and for % lubricant are important in starting and controlling the operation of a processing line but such information does not determine the fitness-for-use of the fiber in terms of a comparative cohesion value. The cohesion value is helpful in this regard by providing a measure of comparative strength of the card web of one sample versus at least one other. In addition, the fiber mat fed to the card and the carded web are examined to determine how well the fibers have been separated.

Favorable comparative cohesion values and normal carding performance with excellent efficiency and production rates (kilograms or pounds carded per hour) can be obtained with our novel fibers, including the most-preferred caustic-treated non-round fibers produced by the novel processes and hot-lubricant-application jets shown in FIGS. 1, 4, and 6.

The determination of an approximate weight % lubricant on a fiber for mineral-oil-based lubricants is made by the infrared test method via analysis of the extract washed from a sample of fiber. Infrared absorption as described by Beer's Law is used to determine the mass of lubricant extracted into a suitable solvent, such as FREON (DuPont Corp.). The analyzer system dispenses solvent which washes the fiber to remove lubricant using a recirculating flow loop. The solution of FREON and lubricant is analyzed for total C—H bonds as it passes through an infrared absorption analyzer flow cell, such as a WILKS-MIRAN IR ANALYSER. The resultant signal is converted electronically to be displayed as the % lubricant (by weight). Conversion factors can be used to enable a single IR lubricant-test instrument to be used for analysis of several different lubricants which have been applied to various types of fibers. For example, a single testing station could be employed 1) to analyze polyester fibers which have been lubricated appropriately for sewing thread, and 2) to subsequently analyze polyester fibers which received lubricant which is suitable for use in certain nonwoven products. An IR lubricant-test instrument (the ROTHERMEL FINISH ANALYZER) can be purchased from Lawson-Hemphill Corp. of Spartanburg, S.C., USA.

Tube elution is the preferred method which can be used for determining the approximate weight % of hydrophilic lubricant such as the novel lubricants on various fibers. In this procedure, a methanol extraction is utilized to try to remove substantially all lubricant components from the fiber, with a subsequent weighing to determine weight percentage lubricant. The tube elution method allows the determination of the amount of lubricant on a pre-weighed sample of fiber by extracting the lubricant with methyl alcohol from the fiber sample which has been packed into an open-ended glass tube. The alcohol is caught in an aluminum dish which is located on a steam bath. The alcohol is evaporated under controlled conditions, leaving the extracted lubricant as a residue. The weight of the residue is gravimetrically measured and the percent lubricant is calculated. Appropriate safety precautions must be taken. These tests for weight % lubricant are generally adequate but do have a certain amount of variability among laboratories, among operators, among repeat samples over time, etc. Thus, it seems that it is not possible to measure exact or precise amounts of lubricant on any fiber. The process of the present invention provides fibers coated with at least one hydrophilic lubricant which provides improved overall performance, particularly when used within certain weight % ranges on certain fibers as described. The preferred minimum amounts of lubricant set forth in this specification should provide some margin for error in application and/or testing.

For the hydrophilic cellulose acetate fibers of Examples 6 and 7, an approximate weight percent of the hydrophilic lubricant was determined substantially as described in ASTM Method D-2257-80 using diethylether in a Sohxlet extraction procedure.

It is helpful to have an estimate of the differences in crimp characterizations such as crimp angle, crimp ratio, and crimp frequency of staple fibers. Crimp affects the carding of the fiber and the subsequent processing of the fiber into a nonwoven fabric. Staple crimp can also affect the bulk, the hand and visual appearance of the finished product. The available test methods for crimp characterization must be used with caution as will be described. Crimp characterizations are important in helping to establish good operating conditions for crimpers and tow dryers. Such characterizations can help detect major differences.

In this method of analyzing crimp, fiber chip specimens of staple fiber are placed on a black plush surface. The crimps along the entire fiber length are counted. Both the relaxed (crimped) and extended fiber lengths are measured in inches or centimeters to one decimal place. The crimp angle and crimp ratio for each sample are then calculated.

Crimp is defined as the waviness of a fiber; a deformation of a filament, or group of filaments, in either the vertical or horizontal plane to the longitudinal axis of the fiber, which is of repetitive nature and is intentionally induced in the fibers by use of external forces. Crimp level is defined as the number of angular peaks (crimps) per inch of extended fiber length, noted as crimps per unit length. Crimp ratio is defined as the direct ratio of the relaxed length of crimped fiber to the extended fiber length. A fiber chip is any group of crimped staple fibers (typically about 10 to 50) which remain in register after being cut at the same time. Crimp angle is a calculated value obtained from the following formula:

$$\text{Crimp Angle } \theta = 2 \sin^{-1} \frac{\text{Relaxed Length}}{\text{Extended Fiber Length}}$$

It is important that the limitations of the crimp frequency and crimp angle tests be understood. Not only are the abilities of these tests to predict "fitness-for-use" not satisfactory, the reproducibility and representativeness of practical samples sizes are not satisfactorily dependable. See ASTM Method D 3937 dated 1980 for the "Users and Significance" section in which severe limitations of the test method for crimp frequency are clearly stated. Also, see the "Applicable Documents" section in ASTM D 3937. This entire method is incorporated herein as a reference.

When it is desirable to prepare the various novel fibers without significant crimp, the crimper rolls can be used essentially as forwarding rolls with no internal steam and with very low pressure applied by the clapper. As an alternative, squeeze rolls followed by appropriate forwarding rolls ("star" rolls) can be located immediately after the hot-lubricant jets to replace the crimper.

Figure 3:
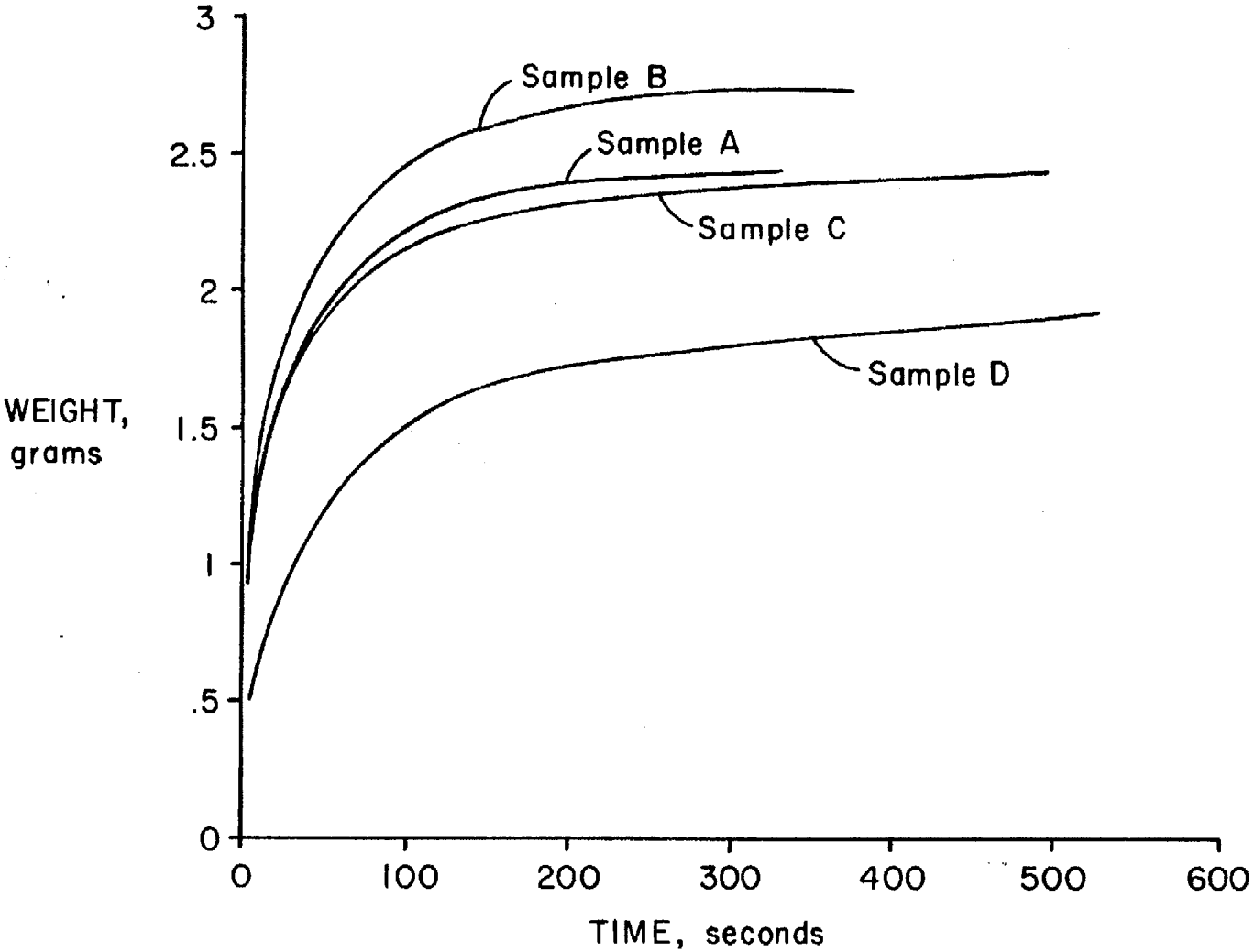
FIG. 3—Graph of the wettability (vertical-wicking performance) of Samples A, B, C, and D from Example 5. This graph illustrates the amount of water in grams transported over time in seconds.

The Automated Vertical Moisture Transport Test is one of the tests used herein to measure the vertical liquid transport capability of the fibers. The fibers are either in original form or scoured by hot-water jet as described and are placed inside a plastic tube. The tube is then mounted vertically. This tube is subsequently brought into contact with a liquid. This test method is designed to automatically measure the fluid uptake of porous or fibrous specimens and to provide a profile of the fluid weight gain of the specimen with time. A fibrous specimen could be in the form of carded sliver or tow. In most applications of interest, the fluid is either water or artificial perspiration and the spontaneous movement of the fluid into the specimen provides a quantitative measure of the surface and capillary forces acting on the fluid in opposition to gravity. Once the specimen is prepared, (by twisting the sliver one turn per 2.54 cm and inserting in a plastic tube of about 7 mm inside diameter and cutting the ends of the sliver cleanly where they project from the 10.2 cm tube), mounted, and the fluid is placed in contact with the bottom edge of the mounted specimen, the computer reads the balance (weight gain of the specimen) at predetermined intervals of time. Preparation of artificial perspiration is described in AATCC Test Method 15-1979. A graph of this data is then printed as shown in FIG. 3.

As the number of suitable liquid transport grooves in the fiber is increased, an increase in denier per filament tends to be needed to maintain the cross-section, spinning performance, production rates, the desired fiber quality and to avoid broken filaments, etc. It is possible to obtain, through spinning and drawing combinations, fibers having final deniers of approximately 5.0 to 200 per filament for the various fibers with about 8 to at least about 20 grooves. However, it is recognized that it could be possible to prepare a denier/filament less than 5.0.

When treating the preferred non-round fibers of the present invention with the hot processing lubricant solution it was unexpectedly found that excess liquid should be removed from the grooves of the fibers prior to contact with the hot solution containing processing lubricant. This is needed for fibers with 2 grooves but even more so for fibers with 8 or more grooves so that the lubricant solution can then flow into the grooves of the fibers. The location of this liquid removal method can be as illustrated in FIG. 1. Any method of effectively removing this excess liquid which is largely water can be considered to be useful within this preferred process of the present invention. However, contact bars; squeeze rolls and air jets are preferred and a novel drying step is most preferred as shown after 2*a* in FIG. 6. A criterion to be used to judge the acceptability of an excess-liquid-removal system is whether or not the desired percent of lubricant can be applied to the fiber satisfactorily after such excess liquid has been removed and the novel controlled drying step is most effective in this regard. Fibers with more than about two grooves such as a fiber with eight grooves (FIG. 2*d*) carry so much liquid (dilute acetic-acid solution) forward to the crimper that the lubricant from the jets essentially rides on the surface of liquid and is not effectively deposited in the grooves to any important degree. The crimper then squeezes the wet fiber causing most of the hot lubricant and residual liquid (weak acetic-acid) solution to be removed, leaving the fiber with a low lubricant level. A fiber with eight or more grooves (FIGS. 2*c* and 2*d*) has a critically greater capacity to pick up acetic-acid solution than the "FIG. 8" with two grooves (FIG. 2*a*).

Two solutions to this residual liquid problem, with the second one representing the more preferred solution, are as follows:

(I) At least one air jet, such as those disclosed in U.S. Pat. Nos. 3,458,890 and 3,786,574, could be equipped with an appropriate hood; return drain; etc. and used following the bars and/or squeeze rolls on the output side of the neutralization bath (located as shown at 1 in FIG. 1) to effectively reduce the level of residual solution on the fiber prior to reaching the hot-lubricant jets and/or other application means for hot lubricant application prior to the crimper.

(II) A most preferred versatile process permits the tow to be substantially dried and/or baked following (1) neutralization, (2) an optional additional washing treatment, (3) a liquid-removal step (such as bars and/or jets and/or squeeze rolls) and (4) an optional lubricant-application step. The fiber is then transported to receive the final application of hot lubricant prior to the crimper. See FIG. 6 for a drawing of this process which could effectively and efficiently apply high levels of the described lubricants to non-round fibers which have at least one groove.

Additionally, the novel hot-lubricant-jet (or jets) illustrated in FIG. 6 can be used to apply lubricant(s) to tow in situations in which the caustic treatment and subsequent neutralization steps are not used. This process can be operated in a variety of ways in order to subject the selected fiber to various operating conditions, temperature(s), treatments, surface coatings, two-step lubricant application, etc.

Fibers with many well-formed grooves can contain more lubricant than those with few such grooves. Fibers with many grooves such as 8 or more preferably have at least about 0.3 wt. % lubricant coated thereon, more preferably between about 0.5 and 2 wt. % of the novel lubricants applied to the surfaces and grooves thereof.

Cross-linking agents, such as epoxidized polyethers and polyglycidyl ethers with suitable initiators, etc., can be applied using the improved processes to alter the surface characteristics of the fiber or to modify the "hand" or feel, etc. The process shown in FIG. 6 provides considerable flexibility. For example, it is possible to conveniently apply the selected cross-linking agent and any initiator which may be needed at jet (or jets) 2A and subsequently apply a processing lubricant containing a minor amount of the cross-linking agent at jet (or jets) 2B, etc. Such cross-linking agents can contain a minor amount of ultraviolet (UV) inhibitors etc.

This improved process (illustrated in FIG. 6), has the capability to apply in a controlled manner, a variety of lubricants and other materials to the selected fibers and to provide the appropriate heat treatments. Thus, versatility is one of the major advantages of this improved process. As illustrated in FIG. 6, it is preferred to contact the fibers with at least a portion of the lubricant or a component of the lubricant (e.g. a solution containing polyethylene glycol 600 monolaurate alone) followed by heat-setting. This portion of the lubricant can be applied for example at 2*a* or between the 4th set of rolls and the 2nd heat-setting unit. This application can then be followed by contacting the fibers with heated lubricant at 2*b*. For crimped fibers this is all preferably conducted prior to the crimper. However (as a novel but much less preferred process) using the process illustrated in FIG. 1, at least one heated component of a lubricant and/or a cross-linking agent can be applied prior to the crimper; the tow is subsequently heat-set; and additional lubricant and/or other components can be applied by a conventional spray booth or brush applicator after the tow dryer.

Relatively undrawn polyester binder fibers and amorphous copolyester binder fibers, etc. can be rendered suitably hydrophilic by the application of at least 0.2% and most preferably at least 0.3 wt. % of the described heated processing lubricants by the process of the present invention. Binder fiber can be blended with at least one other fiber or other material, such as wood pulp, and the blend is then heated to cause the binder fiber to bond with the other component, usually in a compressed state, to make bonded non-woven hydrophilic products with various characteristics. A preferred copolyester binder fiber of about 2 to 8 denier/filament with a 1.5 or 2 inch (about 4 cm) staple length can be prepared from 100 mole % terephthalic acid, 69 mole % ethylene glycol and 31 mole % 1,4-cyclohexanedimethanol. However, other binder fibers, including bicomponent types, can be used. Examples of suitable binder fibers include KODEL 44U (undrawn polyester) and KODEL 410(copolyester) fibers made by Eastman Chemical Company and CELBOND sheath-core, proprietary bicomponent fiber made by Hoechst Celanese Corp. The binder fibers can include side-by-side bicomponent types and those made from polyolefins.

Rendering these fibers strongly hydrophilic provides a novel efficient method by which liquid-transport capability of the final products can be initiated or enhanced. A significant improvement in crimp formation can also be obtained if desired. In a typical application, these fibers are blended with at least one other fiber and subsequently bonded using heat and pressure. However, these novel hydrophilic copolyester binder fibers also can be blended with wood pulp and/or other materials to create products with enhanced overall liquid-transport performance, including durability. When blended with wood pulp, etc., the copolyester is usually cut to short staple lengths of about 0.6 inches (1.5 cm) or less and often contains relatively little or no crimp.

In recent years, the supply of viscose rayon has diminished significantly. However, there are many excellent hydrophilic products containing this fiber which have been developed over the years, such as absorbent products, cleaning fabrics, filters, multi-purpose nonwovens, etc. The novel fibers of the present invention could be used to extend the supply of viscose rayon by making an appropriate blend.

It is believed that high-strength, high quality fibers such as those used in polyester sewing-thread could also be benefited by treatment according to the process of the present invention.

The following examples are intended to further illustrate the invention and are not intended as a limitation thereon.

EXAMPLES

Since fiber lubrication is not an "exact science", the identification above and in the following examples of a "poor" lubricant from the processability standpoint does not mean it will automatically cause a total processing failure on all nonwoven and textile equipment in all situations. However, it is believed that, overall, the poor lubricant, whether hydrophilic or otherwise, would cause significantly more problems, such as weak webs and/or sliver in carding, excessive web breakdowns, holes in the webs and/or uneven (cloudy) webs, difficulty operating consistently at the desired high rate of production, unsatisfactory opening of the staple prior to carding, etc. On the other hand, a "good" lubricant does not automatically process well on all equipment at all times under all conditions. Perhaps, in a given situation, the amount of this lubricant applied to the fiber might not be satisfactory or the fiber crimp could be poorly formed or too variable. There could be cases in which more of the lubricant is required in a particular process in order to perform well, etc. However, it is believed that, overall, this "good" lubricant would be more broadly applicable to a larger number of nonwoven and/or textile processes and/or processing conditions with more favorable results than the "poor" one.

Example 1

The following example illustrates some deficiencies of crimped staple fiber samples that are not prepared according to the present invention. A sample of fiber tow having a "FIG. 8" cross-section was prepared as follows:

Dried fiber-grade polyethylene terephthalate (PET) polymer of 0.63 inherent viscosity (IV) was melt spun at about 293° C. through a spinnerette having 824 holes of dumbbell ("FIG. 8") shape. IV is the inherent viscosity as measured at 25° C. at a polymer concentration of 0.50g/100 milliliters (M1) in a suitable solvent such as a mixture of 60 weight % phenol and 40 weight % tetrachloroethane. The spun fibers of about 4.4 denier per filament (dpf) were wound at 1250 meters per minute.

Two samples of this polyester fiber ("FIG. 8" cross-section) were prepared as drawn crimped staple with about 1.5 denier per filament and 1.5-inch (3.8 cm) staple length using the process essentially as shown in FIG. 1 except without the application of the hot lubricant by the jet prior to the crimper. Approximately 0.15 weight % and 0.3 weight % lubricant was applied at room temperature by a spray method to the tow after the tow dryer.

The lubricant (LUROL 2617 from Goulston Co., Monroe, N.C.) consisted of methyl-capped POE (10) laurate as the major component and quaternary amine carbonate as the minor component. The components were dispersed in water to prepare a 15% emulsion. The necessary guides were used to provide a path to and through the spraying booth and then to the cutter to cut the tow into staple. The weight % lubricant was measured by tube elution as previously described.

The temperature of the first drafting bath with 2% sodium hydroxide solution was maintained at about 69° C. An overall draw ratio of about 3.3 was maintained during the drafting process. The heat-set unit was maintained at a temperature sufficient to produce a tow temperature of about 140° C. After the heat-set unit, the fiber was neutralized with a weak (at least about 0.4 to 0.6% by weight) solution of acetic acid in water at about room temperature or above. Contact bars were mounted on the downstream side of the neutralization bath in order to skim off a major portion of the liquid. The fiber was crimped and then heat-set at about 97° C. for about 5 minutes after crimping; was lubricated and then cut into about 1.5-inch (3.8 cm) staple. These samples were run on a Research processing line using a total tow denier of about 50,000 to 60,000. The tow had an average of 11 to 13 crimps per inch (about 5.1 crimps per cm) with approximately a 90-to-100 degree average crimp angle. The crimps per unit length and the crimp angle were measured as previously described.

These two caustic-treated fiber samples had good liquid-transport capability but had variable crimp with relatively wide (open) crimp angles and poor cohesion values. Carded webs from various samples of this fiber tended to be weak with some uneven webs and/or web failures due to low cohesion.

Cohesion values for these fibers were determined by the instrument and method disclosed in U.S. Pat. No. 4,649,605 as previously described. The cohesion values for these fibers were low, averaging about 4.0 to 5.0. As previously indicated, the cohesion number is intended to be used to indicate comparative cohesion of staple fibers. The cohesion values are determined during carding and indicate comparative strengths of card webs representing the various samples.

Example 2

The purpose of this example is to illustrate the liquid-transport performance of fibers prepared using various aspects of the present invention when compared to noninventive aspects. A number of samples were prepared and tested for drop-wetting performance. The following conditions were used in this study using a Research processing line and about 55,000 total tow denier operated at a speed of about 40 meters per minute:

1. Polyester: Polyethylene terephthalate melt spun using the conditions essentially as described in Example 1 with spinnerettes for round and "FIG. 8" cross-sections.
2. Denier and staple length: about 1.5×1.45 inches (3.7 cm)
3. Fiber cross-sections: Round and "FIG. 8" (One 180 kg creeling of undrawn fiber was spun for each cross-section.)
4. Treatments: 2% caustic (C) followed by neutralization as described above and in U.S. Pat. No. 4,842,792 or no caustic (N).
5. Lubrication methods for the various samples: Two hot-lubricant jets (HLJ) located above the tow, as shown in FIG. 4 placed within 30 inches (75 cm) of the crimper input using the process shown in FIG. 1; prior-art lubrication after crimping (LAC); or no lubricant (NL).
6. Lubricant target for all samples: 0.4±0.05 weight % using the same lubricant as used in Example 1.
7. Heat-setting treatment after crimping: 145°±6° C. for approximately 5.0 minutes with hot air circulation. Of course, the damp tow entering the dryer is not at this temperature for the entire time.
8. Drop-wetting test method: AATCC 39-1971.
9. Tow tensions after the tow dryer through the cutter for Samples A, B, D, F and G were maintained at the minimum that was consistent with good operation of the cutter. The minimum air flow necessary to transport the staple from the cutter through the delivery system to the collection system was used. Tow tensions for the Samples C and E (lubricated after crimping) were higher at the cutter than the other samples because it was necessary to pass over the guides and rollers that guided the tow to and through the lubricant-spray booth prior to the cutter as shown in FIG. 1. It was not necessary for samples A, B, D, F and G to pass through this booth.
10. Nonwoven fabric construction: about 16 grams/sq. yard (19.1 grams per sq. meter) of carded fiber was powder-bonded with about 4 grams/sq. yard (4.8 grams per sq. meter) of EASTOBOND 252 polyester powder. The batting was created in two layers from two nonwoven carding machines located to deliver one layer on top of the other prior to the powder-application machine with subsequent heating and passage through bonding rolls to compress the material to form a thin sheet of bonded nonwoven fiber. This powder-bonding method is well known in the nonwoven manufacturing industry.
11. Scouring method: Hot-water jet as described above. The jet delivered about 1100 cubic centimeters of water per minute which had been heated to about 54° C. with a pressure at the jet of 20 psig (138KPa) maintained at about 6 inches (15.2 centimeters) from the nonwoven samples (22.9×71.1 centimeters per sample) for 60 seconds.

Each sample of nonwoven fabric was tested for drop wetting in the original form and after receiving a 60 -second scour. The average drop-wetting results (in seconds) are as set out in Table 2.

TABLE 2

| Sample | Cross-Section | C/N | HLJ/LAC or NL | Drop-Wetting Time*** After Samples Were Scoured for: 0 Sec | 60 Sec |
|---|---|---|---|---|---|
| A. | FIG. 8 | C | HLJ | 2.8 | 4.3 to 7** |
| B. | FIG. 8 | N | HLJ | 2.8 | 48 |
| C. | FIG. 8 | C | LAC | 6.2 | 82 |
| D. | Round | C | HLJ | 4.8 | 118 |
| E. | Round | C | LAC | 7.6 | 600 |
| F. | Round | N | HLJ | 11.8 | 600 |
| G.* | FIG. 8 | N | NL | 600.0 | 600 |

*A light water spray was necessary in order to process this unlubricated fiber through carding. The carding performance of Sample G was very poor and the resultant powder-bonded fabric was not uniform. Sample G does provide an indication of the large difference in the drop-wetting performance of unlubricated fiber compared to (1) non-round fiber (Sample C); (2) one embodiment of the novel fibers (Sample A); and (3) the other samples representing the various treatments shown above.

**Multiple tests were run on the scoured samples for the more preferred novel fiber.

***It is recognized that there is a certain amount of variability in the AATCC 39-1971 procedure caused by visual recognition and judgment of the end point at which the drop has been fully dispersed. To reduce variability, these tests were performed by one senior operator to make comparisons among samples as accurate as possible. Other operators could obtain differences in absolute time measurements due to the recognition and judgment factors.

Figure 5:
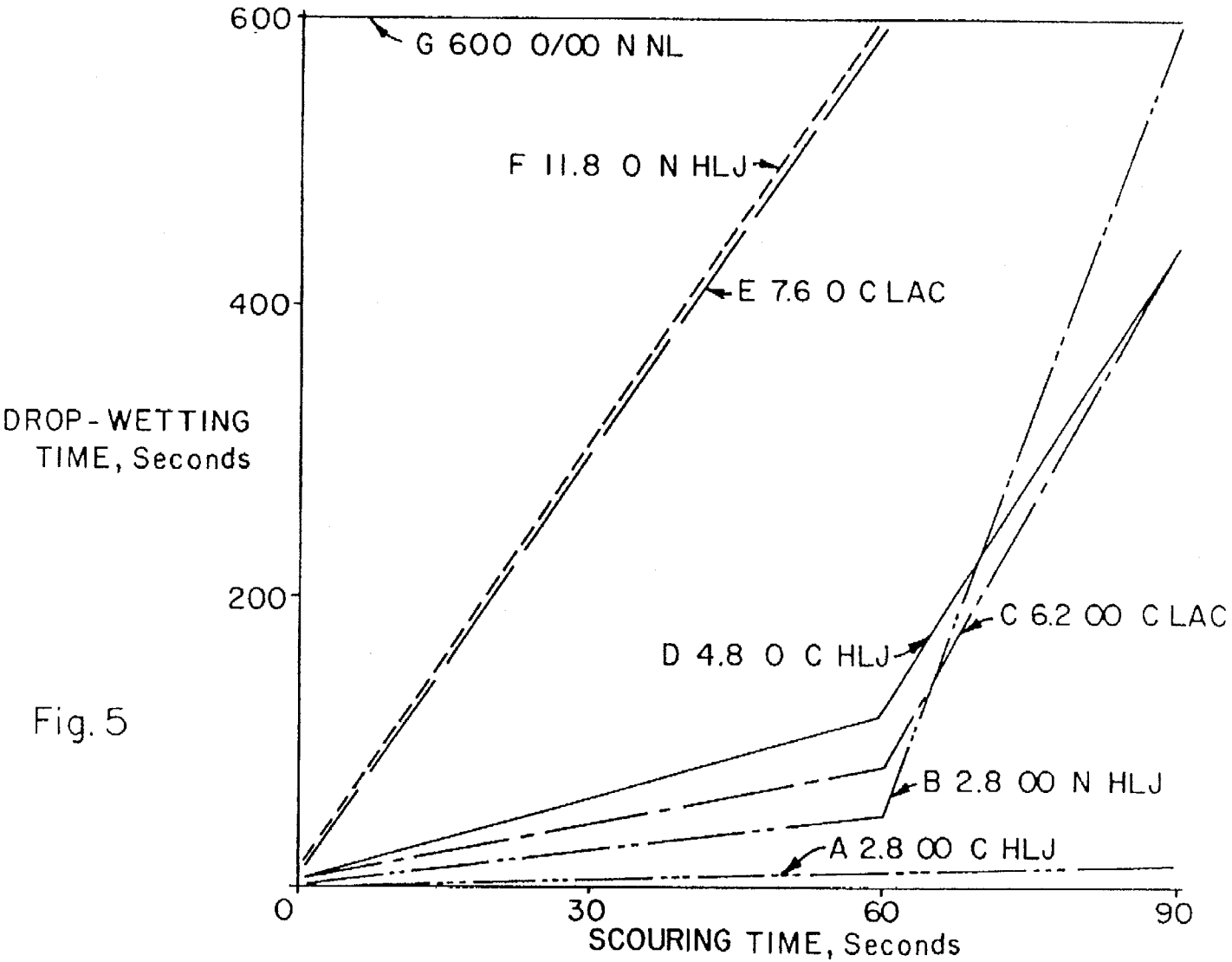
FIG. 5—Graph representing the drop-wetting time in seconds of various nonwoven fabrics made from the various fiber samples as described in Example 2.

The results were plotted graphically as shown in FIG. 5 representing the wetting time in original condition and after scouring for 60 seconds.

The results for Sample F indicated that round cross-section fiber processed without caustic but with the hot-lubricant jets (to attempt to improve crimp formation) had relatively poor liquid-transport durability. Unexpectedly, the results for Sample B indicate that, even without caustic, the hot-lubricant-jet process followed by crimping and heat-setting as previously described could be of benefit in preparing products for at least one-time use (nonwovens for cleaning applications, wipes, incontinence products, etc.). The tests on Sample G, which was not lubricated with a hydrophilic product, did not produce satisfactory drop-wetting results.

In view of these overall results, our inventive process with less preferred lubricants provided drop wetting at least equal to and possibly somewhat better than the conventional processes.

Example 3

Except for heat-setting at about 75° C. instead of about 145° C., fiber essentially identical to Sample A in Example 2 was prepared using two hot-lubricant jets located above the tow as shown in FIG. 4. Approximately 0.4 weight % lubricant was applied. This lubricant consisted of 70 weight % polyethylene glycol 600 monolaurate and 30 weight % polyoxyethylene (5) potassium lauryl phosphate prepared as 15 % emulsion in water. This sample had excellent wettability. However, when tested for cohesion during carding using the method previously described, the crimped staple sample had poor (low) cohesion and thus did not provide an acceptably balanced overall performance.

Example 4

Fiber-grade PET polymer of 0.64 IV was melt spun at 280° C. through a 16-hole spinnerette to make filaments with "8-groove" cross-sections somewhat similar to that illustrated in FIG. 2*d*. The 40 denier per filament fiber was spun at 1500 meters per minute and subsequently was processed on a tow-processing line as shown in FIG. 1. The total tow denier was about 55,000.

About 400 pounds (182 Kg) of this eight-groove fiber were spun and wound onto tubes in the relatively undrawn state; placed in the creel on the Research processing line; drafted with approximately 2-to-1 overall draw ratio in a heated bath containing 2% caustic to obtain about 20–22 denier per filament; processed through the steam chest and heat-setting unit; immersed in the neutralization bath containing weak acetic acid (about 0.5%); and treated with two top hot-lubricant jets in series as shown in FIG. 4 prior to the crimper and tow dryer with the objective of obtaining at least about 0.4 to at least about 2% lubricant by weight dried onto the hydrolyzed fiber which was prepared in the form of crimped staple. See FIG. 1 for a drawing of this process. The lubricant was the same type as was used in Example 3.

Except for the necessary change in draw ratio, the processing conditions were similar to the ones used successfully on the "FIG. 8" fiber as shown in the previous examples. However, the desired percent lubricant was not obtained. Surprisingly, two separate tests indicated that the lubricant level was only about 0.03 to 0.1 weight % using the same tube elution test that was used in the previous examples. After doubling the concentration of the lubricant supply from 20 to 40 weight %, the fiber had only about 0.19 wt. % which was far below the most preferred minimum application of at least 0.5 wt. % or more for fibers with about 8 or more grooves. As the concentration of the lubricant supply was increased to 40 wt. %, the lubricant became thicker and difficult to work with, even when heated, and proper penetration into the tow band became increasingly difficult to achieve.

Moreover, with the jets fully open, there was a large loss of lubricant which poured over the sides of the tow into the lubricant drain. The crimper-roll pressure was then reduced to allow more lubricant to be carried forward with the tow, however, crimp formation deteriorated and was unacceptable.

We discovered that excessive liquid retention in the grooves was the problem. This excessive liquid simply blocked the lubricant from properly entering the grooves. A novel process was then designed to overcome this problem as illustrated in FIG. 1 with at least one Partial Liquid Removal Means 1. In this case, in addition to the wiper bars that had been used for the "FIG. 8" samples, an air-jet system was installed after the bars to remove the excessive liquid after the neutralization bath and prior to the hot-lubricant jets.

Using this novel process with a concentration of about 25 wt. % of the lubricant in solution, fibers with eight grooves were prepared with at least 0.5 to 1.5 wt. % of the lubricant of Example 3 dried on in the tow dryer as has been previously described. The fiber was found to be hydrophilic.

Example 5

Caustic-treated fiber similar to that made for Sample A in Example 2 (except as stated below) was prepared using two hot-lubricant jets operated at about 80° C. located above the tow as shown in FIG. 4. The crimped tow was dried in the tow dryer at 65° C. for about 5 minutes. This example compares the fiber opening, carding performance, cohesion values and vertical-wicking performance of four hydrophilic lubricants applied by hot-lubricant jets to 1.5 denier per filament, 1.5 inch, polyester fiber in a "FIG. 8" cross-section. The fiber for all four lubricants was produced on the same line in an effort to hold processing variability to a minimum. The desired minimum weight % lubricant was at least 0.3. The crimp frequency was approximately 14 to 16 crimps/inch. The approximate mean crimp angle of about 70 degrees was obtained using the estimation method described in Example 9. However, as previously stated, crimp frequency and angle are useful rough estimates to have in setting up the operation of a processing line but are not sufficiently reproducible for acceptance sampling and do not provide an adequate indication of carding performance.

The samples were treated as set forth in Table 3.

TABLE 3

| | | Wt. % Lubricant | | |
|---|---|---|---|---|
| | Lubricant Components | Test Performed On Crimped Staple | Tested Later On | |
| Sample | By Wt. % | Sample at the Cutter | Carded | Sliver |
| A | 90 PEG 600 Monolaurate<br>10 Antistat* | 0.36 | 0.47 | 0.48 |
| B | 45 PEG 400 Monolaurate<br>45 PEG 600 Monolaurate<br>10 Antistat* | 0.42 | 0.52 | 0.56 |
| C | 90 PEG 400 Monolaurate<br>10 Antistat* | 0.39 | 0.47 | 0.46 |
| D | Lubricant same as Example 1 | 0.32 | 0.34 | 0.34 |

*4-ethyl, 4-cetyl, morpholinium ethosulfate

The samples were made on a single processing line using the same crimper (¾' width rolls) adjusted by the same experienced operators. The tests for % lubricant by weight (using tube elution) indicated that at least 0.3 weight % had been applied to all samples by the two hot-lubricant jets (minimum had been met). The tests that were made on the crimped staple sampled at the cutter during processing indicated an overall tight grouping of results centering around an average of about 0.37 weight %. However, when the carded sliver was tested later, it was found that, overall, Samples A, B and C had very good agreement as a group in average weight % lubricant but that Sample D was about 0.12 to 0.22 weight % lower than A, B and C. Sample D did exceed our minimum target of 0.3 wt. % in tests on both staple and sliver. Each sample was placed in a chute-feed system to be subsequently opened by tumbling, spike apron, fine opener and air currents in the standard manner and then automatically fed to a textile carding machine which was equipped with a cohesion-test unit as described. The following results in Table 4 were reported by the Technical Service Laboratory personnel who conducted the evaluations:

TABLE 4

| Sample | Fiber Opening Performance | Observation of Carded Web For Strength | Comparative Weighted-Average Cohesion Value |
|---|---|---|---|
| A | Good | Weak | 4.6 |
| B | Good | Normal | 5.7 |
| C | Not Satisfactory | Normal | 6.4 |
| D | Good | Normal | 5.6 |

Overall, no advantage was found for sample D over Sample B. The tests and observations were made by experienced carding operators who have made many such tests on various types of polyester fibers over a number of years.

Thus, the results show that the lubricant formulation of Sample A provided good fiber opening but poor cohesion while the formulation for Sample C did not provide satisfactory fiber opening but did provide good cohesion. The results further indicate that when combined as was done for Sample B, the components provided good overall performance as shown above. In addition, the results indicate that the proportions of the components of the lubricant used for Sample B could be varied to a certain extent to provide increased or decreased responses for different fibers and to satisfy different final objectives.

Carded sliver (65 grain) from each of the four samples was saved for evaluation by the Automated Vertical Moisture Transport Test previously described. Average capacity of each sample expressed as the weight of liquid per gram of fiber (grams/gram) was as follows:

Sample A—4.9

Sample B—5.3

Sample C—5.3

Sample D—4.2

The results are shown in FIG. 3 and indicate that the novel 3-component lubricant (Sample B) is least as effective in vertical transport as the lubricants used for Samples A, C and D and possibly slightly more effective in this regard. The unexpected results indicate that the novel three-component lubricant-antistat, particularly when applied in a heated condition by our novel jets, provides improved, well-balanced, overall performance and improved overall margin of safety in terms of fiber opening, cohesion, and processability with at least equal and possibly somewhat better hydrophilic performance compared to prior art. Additional versatility is indicated by favorable results obtained with different cross-sections and fiber polymers. The preferred application method is by our novel hot-lubricant jet process but other application means can be considered.

Example 6

The purpose of this example is to illustrate the use of the present invention on fibers other than polyester. Using the well known solvent-spinning process (acetone), cellulose acetate fibers of 3.3 denier per filament in a "Y-shaped" cross-section were spun from multiple cabinets and then were guided across a lubricating roll and into a crimper to form a 50,000 total denier crimped tow. This tow was then introduced under suitable low tension to the first set of rolls of the process shown in FIG. 1. The tow was passed through a draw bath at about 60 degrees C. using a draw ratio of about 1.2 to 1. A portion of this drawing step was used to remove the original crimp to create a tow with little or no crimp for this experiment. The bath was equipped with Liquid-Removal Means 1 on the output side and the tow subsequently passed through a steam chest and the heat-setting unit both of which were maintained at about 100 degrees C. The bath and liquid-removal means were also used to remove at least the most easily accessible portion of the spinning lubricant (mineral-oil based).

A hot-lubricant jet applied the most preferred and novel hydrophilic lubricant (heated to 80° C.) immediately prior to the 0.5-inch width crimper. The lubricant was composed of 49 wt. % PEG 400 monolaurate, 49 wt. % PEG 600 monolaurate and 2 wt. % 4-ethyl, 4-cetyl, morpholinium ethosulfate at a 20 wt. % concentration in water. These are the same three components used to prepare the lubricant for Sample B in Example 5 but with the antistat reduced to 2 wt. % with a corresponding increase in the other two components to 49% each. Approximately 0.75 wt. % of the lubricant was applied to the fiber. The crimped tow was dried at about 70° C. for about 5 minutes. The resultant staple had a relatively dry hand.

This test was intended to determine whether or not a relatively low level (for cellulose acetate) of lubricant would be satisfactory for 1) processability on a nonwoven carding machine and 2) liquid-transport properties. The lowest satisfactory tension for cutting a 2-inch staple length was used. The staple was found to have about 12 to 14 average crimps per inch at about an 85 to 90 degree average crimp angle using the estimated method described in Example 9.

In a small-scale experiment, it was possible to card the fiber (on a carding machine for nonwovens) but there was a definite indication of static at this weight % of the lubricant. Thus, it was clear that for production purposes, at least a higher level of the antistatic component and perhaps the other components of the lubricant would be needed for cellulose acetate fiber.

The carded web was then subjected to a needle-punching operation in order to create a nonwoven fabric which was suitable for testing. The needle-punched nonwoven weighed about 3.8 ounces per square yard with a thickness of about 0.106 inches under a pressure of 0.01 pounds per square inch. The fabric had good liquid-transport properties as indicated by basket-sink tests in distilled water. The average basket-sink time was 5.38 seconds obtained from the following individual tests: 7.65, 5.30 and 3.20 seconds.

The cellulose acetate samples described in this Example 6 created a special analysis problem due to the fact that mineral-oil-based lubricant was applied during spinning and was only partially removed by the drafting bath prior to application of heated hydrophilic lubricant as subsequently described. It was necessary to heat these samples for 16 hours at about 100° C. in order to substantially remove the mineral oil before performing the tube-elution procedure. The dried samples were allowed to condition for about 8 hours to determine % moisture regain and were then dried at about 120° C. for about 30 minutes prior to performing the tube elution procedure.

Example 7

This example was conducted substantially according to Example 6 except that the heat setting unit temperature was set at about 140° C. and at least about 3 weight % of the lubricant was used:

The fiber was blended with 20 weight % KODEL 410 binder fiber and processed to form a bonded nonwoven fabric of about 40 g./sq. yd. This bonded fabric was found to contain about 1.5 wt. % of the lubricant. There was no indication of significant static. The bonded nonwoven fabric had an average drop-wettability of 1.3 seconds with a low value of 0.6 and a high value of 2.8 seconds. An average wetting time of 1.2 seconds was obtained in the basket-sink test.

Example 8

Fiber similar to Sample A in Example 2 was prepared using three hot-lubricant jets as illustrated in FIG. 4. Approximately 0.4 to 0.5 weight % of the following lubricant was applied at a temperature of about 85 degrees C.:

45 weight % PEG 400 monolaurate 45 weight % PEG 600 monolaurate 10 weight % 4-ethyl, 4-cetyl, morpholinium ethosulfate The lubricated, crimped tow was heat-set at about 75° C. in the tow dryer.

In order to properly seal off excess lubricant flow, it was helpful to cover the holes in the bottom jet which extended beyond the edges of the tow. These holes can be covered in any suitable manner, however, adjustable collars were used as shown in FIG. 4. Then at least one bottom jet was oriented as shown to prevent, as much as is practical, any dry contact between the jet surface and the tow. Preferably, the fiber-contact surfaces of the bottom jet are coated with a suitable long-wearing material, such as a ceramic coating.

No problems were found in using the novel three-jet lubrication apparatus and method in this test. Excessive flow was provided to the bottom jet with a return of excess lubricant to the lubricant heating and supply tank. Since three jets were not required to apply the target lubricant level to this about 55,000 to 60,000 denier tow, the bottom jet was removed to continue the experimental work using the top two jets. The fiber was "FIG. 8" polyester of about 1.5 denier per filament by about 1.5-inch staple length. We concluded that the novel three-jet design shown in FIG. 4 would be of major benefit in applying heated lubricant to the large tows of at least about 800,000 total denier up to several million total denier which are typical of full-scale production lines for polyester and other fibers.

Example 9

This example is a further illustration of the overall performance of the three-component lubricant-antistat composition used in Sample B in Example 5. An "8-groove" polyester fiber drafted to about 5.9 denier per filament and crimped following application by jet of about 0.6 to 0.9 wt. % of this novel lubricant heated to about 80°–85° C. The analyses of the wt. % lubricant on the fiber were 0.58 and 0.94 and represent two different tests conducted when the fiber was being run and then later sampled from storage. These results are further examples of variability that we have found at times in repeat tests and also between laboratories, etc.

The crimped fiber was heated in the tow dryer at about 66 degrees for 5 minutes. The average crimp frequency was about 12 to 14 crimps per inch with a crimp angle estimated to be about 69 degrees.

The estimation method for crimp angle involves comparing lengths of crimped tow to the lengths obtained after straightening the same tow and converting the ratio of the lengths to an estimate of the average crimp angle.

The staple was cut to about 1.5 inches. It is important, particularly for non-round fibers such as illustrated in FIGS. 2*a*, 2*b*, 2*c* and 2*d* to maintain the lowest tow tension entering the cutter that is consistent with satisfactory control of staple length in order to avoid excessive increases in crimp angle with a reduction in cohesion.

The textile carding machine used for this example was adjusted for running about 1.5 or less up to about 3.0 denier/filament with the most satisfactory carding performance for these general multi-purpose settings. However, this carding machine was equipped and set in such a manner that it was possible to run staple up to about 7.0 denier/filament with at least acceptable web formation even though this is outside that most satisfactory range. The 5.9 denier/filament fibers of this example were run on the same carding machine equipped with a cohesion test instrument which was used for the other cohesion tests in order to obtain a weighted-average cohesion value to compare against the values obtained in Example 5. With the denier/filament outside the most satisfactory range, some undesirable balled-up and tangled fibers were produced between the carding cylinder and the fixed flats of the carding machine. However, it was possible to produce an acceptable web for testing and a cohesion value of 5.6 was obtained. The web was judged to have at least adequate strength. Thus, the novel hot-lubricant-jet process and novel three-component lubricant-antistat could be used satisfactorily for overall performance of the "8-groove" fiber previously described. The carded sliver was found to be hydrophilic.

Example 10

An "8-groove" polyester fiber was produced under the following conditions:

| | |
|---|---|
| Drafting-bath temperature | About 72° C. |
| Liquid-removal means | Contact bars and air jet |
| Steam tube temperature | About 185° C. |
| Caustic treatment | None |
| Neutralization treatment | None |
| Heat-setting rolls | Not heated |
| Crimper width | 0.5 inches |
| Tow-dryer temperature | About 130° C. (5 minutes) |
| Total tow denier | About 55,000 |
| Crimp per inch | About 12 to 14 |
| Estimated crimp angle by the tow-estimation method: | All samples were estimated to be greater than 90° with the samples lubricated by hot-lubricant jet having somewhat sharper angles than spray-booth samples. |
| Weight % lubricant applied* | |
| a. PEG 880 sorbitan monolaurate | 0.49 by jet (about 80–85° C.) |
| b. Same as a. | 0.55 by spray (room temperature) |
| c. PEG 880 sorbitan monostearate | 0.47 by jet (about 80–85° C.) |
| d. Same as c. | 0.49 by spray (room temperature) |

*Each lubricant consisted of 98 wt. % of the major ingredient plus 2 wt. % 4-ethyl, 4-cetyl, morpholinium ethosulfate antistatic agent mixed as a 20 wt. % concentration in 80 wt. % water.

| | |
|---|---|
| Denier/filament ("8-groove" fiber) | About 10 ± 0.5 |
| Staple length | About 2 inches |

These fibers were subsequently bonded using KODEL 410 binder fiber as previously described to form an approximately 40-gram per square yard bonded nonwoven in which the fibers are heated and compressed to form the fabric in a manner well known in the art.

All four nonwovens were found to be hydrophilic in basket-sink and drop--wetting tests. This process in which the tow dryer was operated at 130° C. was found to open tow crimp angles significantly wider than the angles obtained in Example 5 in which hot-lubricant application of the preferred lubricant formulations was used prior to crimping with the tow dryer operated at less than about 85° C. See Example 5 for comparison in which the heat-setting rolls are heated and the tow dryer is operated at a temperature below about 85° C. The process illustrated in this Example 10 is less preferred than the process illustrated in Example 5 but can be used in those situations in which the resultant fiber is found to perform at least acceptably in the subsequent nonwoven and/or textile processes.

Example 11

This example illustrates the application of the novel three-component lubricant-antistat composition used in Example 7 in an effort to attempt to create a hydrophilic binder fiber. KODEL 410 binder fiber (previously described) was chosen. A relatively hydrophobic lubricant (mineral-oil type) had been used satisfactorily on this fiber for a number of years for various nonwoven applications.

About 0.25 weight % of the lubricant of Example 7 was applied to the KODEL 410 binder fiber (about 8 denier/filament) by a spray booth at room temperature. Subsequently, this fiber was blended with a major portion (about 80 wt. %) of an "8-groove" crimped staple. It was found that, during opening and feeding of the fiber, the binder fiber had become brittle and broke into many small lengths. Laboratory testing revealed that this fiber had lost a significant amount of strength and % elongation. Over a period of 50 days, the fiber became rapidly more brittle and weaker with sharply reduced elongation and is therefore not suited for this application as a binder fiber.

Example 12

This example illustrates the application of the two novel lubricants of Example 10 on separate samples and to attempt to provide a binder fiber with improved hydrophilic action. The lubricants used in Example 10 were applied at about 0.25 wt. % to samples of tow used to make KODEL 410 staple fiber. Over a period of 50 days, the tow samples had only slight losses of strength and elongation. Thus, these two lubricants would be satisfactory to use in preparing binder fiber with hydrophilic properties.

Example 13

In an aging test of the novel three-component lubricant, hydrophilic, bonded nonwoven fabrics of sample B in Example 5 and Example 7 were stored for over 7 months and were then examined. It was found that the bonded structure and hydrophilic function of these fabrics had been retained.

We claim:

1. An article of manufacture comprising fibers having a denier per filament of about 0.8 to 200 selected from fibers of the group consisting of polyester fibers, polyolefin fibers, polyphenylene sulfide fibers, cellulose acetate fibers, modacrylic fibers, nylon fibers, viscose rayon fibers, cotton fibers, and fiber blends thereof having about 0.1 wt. % or more of a lubricant comprising a mixture of high and low molecular weight polyethylene glycol fatty acid esters on the surfaces of the fibers, wherein said lubricant contains a high molecular weight polyethylene glycol fatty acid ester that has a molecular weight in the polyethylene glycol portion above 500 and a low molecular weight polyethylene glycol fatty acid ester that has a molecular weight in the polyethylene glycol portion below 500.

2. The article of manufacture according to claim 1 wherein said lubricant contains about 1 to 20 wt. % of an antistatic agent.

3. The article of manufacture according to claim 2 wherein said antistatic agent is selected from the group consisting of quaternary amine salts, salts of polyoxyethylene inorganic fatty alcohol esters, ethosulfate salts of quaternary ammonium compounds, and acid salts of quaternary ammonium compounds.

4. The article of manufacture according to claim 2 wherein said low molecular weight polyethylene glycol fatty acid ester is polyethylene glycol 400 monolaurate in a concentration in the lubricant of at least 40 wt. %, said high molecular weight polyethylene glycol fatty acid ester is polyethylene glycol 600 monolaurate at a concentration in the lubricant of at least 40 wt %, and wherein said antistatic agent is 4-ethyl, 4-cetyl, morpholinium ethosulfate in a concentration in the lubricant in an amount up to 10 wt. %.

5. The article of manufacture according to claim 1 wherein said fibers are coated with at least 0.3 weight percent of said lubricant, based on the total weight of fiber and lubricant.

6. The article of manufacture according to claim 1 wherein said fibers have at least one axial groove.

7. The article of manufacture according to claim 1 wherein said fibers are selected from fibers of the group consisting of caustic-treated fibers, fibers having a cross-linked exterior coating, and crimped fibers.

8. The article of manufacture according to claim 1 wherein said lubricant contains at least one other additive separate from the lubricant selected from the group consisting of spinning lubricant, dye chemicals, aroma-enhancing agent, scouring agent, antifungal agent, antibacterial agent, defoamer, super-absorbent polymer, fluorescent additive, mineral oil, and antiseptic additive.

9. The article of manufacture according to claim 1 wherein said fibers are in the form of an article selected from the group consisting of nonwovens, filters, knitted material, woven material, absorbent pads, insulation, liners, wicks, bonded battings, bandages, incontinence structures, sewing thread, and fibers blended with wood pulp.

10. An article of manufacture comprising fibers having a denier per filament of 0.8 to 200 (0.89 to 222 decitex) selected from fibers of the group consisting of polyester fibers, cellulose acetate fibers, modacrylic fibers, nylon fibers, polyolefin fibers, polyphenylene sulfide fibers, viscose rayon fibers, cotton fibers, and blends thereof, having 0.1 wt. % or more of a lubricant comprising at least one polyethylene glycol monolaurate or monostearate having a sorbitan group on the surfaces of the fibers.

11. The article of manufacture according to claim 10 wherein said polyethylene glycol monolaurate or monostearate having a sorbitan group is selected from the group consisting of polyethylene glycol 880 sorbitan monolaurate, polyethylene glycol 880 sorbitan monostearate, and mixtures thereof.

12. The article of manufacture according to claim 10 wherein said lubricant contains about 1 to 20 wt. % of an antistatic agent.

13. The article of manufacture according to claim 12 wherein said antistatic agent is selected from the group consisting of quaternary amine salts, salts of polyoxyethylene inorganic fatty alcohol esters, ethosulfate salts of quaternary ammonium compounds, and acid salts of quaternary ammonium compounds.

14. The article of manufacture according to claim 10 wherein said lubricant contains a cross-linking agent.

15. The article of manufacture according to claim 10 wherein said fibers prior to being coated with said lubricant are fibers selected from the group consisting of caustic-treated fibers and fibers with a cross-linked exterior coating.

16. The article of manufacture according to claim 10 wherein said lubricant contains at least one other additive separate from the lubricant selected from the group consisting of spinning lubricant, dye chemicals, aroma-enhancing agent, scouring agent, antifungal agent, antibacterial agent, defoamer, super-absorbent polymer, fluorescent additive, mineral oil, and antiseptic additive.

17. The article of manufacture according to claim 10 wherein said fibers are binder fibers.

18. The article of manufacture according to claim 10 wherein said fibers are crimped fibers.

19. The article of manufacture according to claim 10 wherein said fibers are in the form of an article selected from the group consisting of nonwovens, filters, knitted material, woven material, absorbent pads, insulation, liners, wicks, bonded battings, bandages, incontinence structures, sewing thread, and fibers blended with wood pulp.

* * * * *